US007059545B2

(12) United States Patent
Reetz, III

(10) Patent No.: US 7,059,545 B2
(45) Date of Patent: Jun. 13, 2006

(54) AUTOMATIC AIR-ASSISTED MANIFOLD MOUNTED GUN

(75) Inventor: Eric F. Reetz, III, Broomfield, CO (US)

(73) Assignee: Illinois Tool Works Inc., Genview, IL (US)

( * ) Notice: Subject to any disclaimer, the term of this patent is extended or adjusted under 35 U.S.C. 154(b) by 0 days.

(21) Appl. No.: 11/010,112

(22) Filed: Dec. 10, 2004

(65) Prior Publication Data

US 2005/0098655 A1 May 12, 2005

Related U.S. Application Data

(62) Division of application No. 10/366,251, filed on Feb. 13, 2003, now Pat. No. 6,874,708.

(51) Int. Cl.
*B05B 7/12* (2006.01)

(52) U.S. Cl. ..... 239/413; 239/575; 239/569; 239/583; 251/62; 251/63

(58) Field of Classification Search ..... 239/569, 239/575, 571, 570, 579, 600, 14, 290, 99, 239/101, 296, 574, 553, 413; 51/62, 63, 51/583

See application file for complete search history.

(56) References Cited

U.S. PATENT DOCUMENTS

| | | | | |
|---|---|---|---|---|
| 2,019,941 | A | | 11/1935 | Tracy |
| 3,561,680 | A | * | 2/1971 | Ott ..... 239/411 |
| 3,912,630 | A | | 10/1975 | Reighard et al. |
| 3,986,672 | A | | 10/1976 | Smith et al. |
| 4,219,157 | A | | 8/1980 | Binoche |
| 4,349,153 | A | | 9/1982 | Johnson |
| 4,386,739 | A | | 6/1983 | Kwok |
| 4,488,665 | A | | 12/1984 | Cocks et al. |
| 4,724,860 | A | | 2/1988 | Kelch |
| 4,728,722 | A | | 3/1988 | Mueller |
| 4,763,684 | A | | 8/1988 | Kelch |
| 4,776,083 | A | | 10/1988 | Sakamoto et al. |
| 4,783,363 | A | | 11/1988 | Berman et al. |
| 4,791,543 | A | | 12/1988 | Chadwick et al. |
| 4,796,796 | A | | 1/1989 | Habraken |
| 4,842,203 | A | | 6/1989 | Kuhn et al. |

(Continued)

FOREIGN PATENT DOCUMENTS

EP 0 239 891 10/1987

(Continued)

OTHER PUBLICATIONS

"MACH 2A Hydraulically-Assisted HVLP Spray Guns", parts sheet, Binks, Jan. 2001, 8 pages.

(Continued)

*Primary Examiner*—David A. Scherbel
*Assistant Examiner*—Jason Boeckmann
(74) *Attorney, Agent, or Firm*—Barnes & Thornburg LLP

(57) ABSTRACT

A coating material dispensing device includes a first component providing a connection to a source of coating material to be dispensed and a filter for filtering coating material to be dispensed. The first component includes a housing for housing the filter and a closure for selectively closing the housing to permit removal and replacement of the filter. The coating material dispensing device further includes a second component providing a nozzle through which the coating material is dispensed. The first and second components include first and second passageways, respectively. The first and second passageways communicate when the first and second components are assembled together to provide a flow of filtered coating material from the filter to the nozzle.

14 Claims, 22 Drawing Sheets

U.S. PATENT DOCUMENTS

| | | | | |
|---|---|---|---|---|
| 4,907,493 | A | 3/1990 | Bellanger et al. | |
| 5,158,779 | A | 10/1992 | Gergely et al. | |
| 5,344,078 | A | 9/1994 | Fritz et al. | |
| 5,435,491 | A | 7/1995 | Sakuma | |
| 5,505,566 | A * | 4/1996 | Gruber | 406/12 |
| 5,706,982 | A | 1/1998 | Siddiqui et al. | |
| 5,894,994 | A | 4/1999 | Keane et al. | |
| 5,899,387 | A * | 5/1999 | Haruch | 239/296 |
| 6,260,583 | B1 | 7/2001 | Flatt et al. | |
| 6,264,113 | B1 * | 7/2001 | Dingler | 239/290 |
| 6,276,616 | B1 | 8/2001 | Jenkins | |
| 6,378,783 | B1 * | 4/2002 | Ballu | 239/290 |
| 6,422,428 | B1 | 7/2002 | Allen et al. | |
| 2003/0080155 | A1 | 5/2003 | Jeter | |

FOREIGN PATENT DOCUMENTS

| | | |
|---|---|---|
| EP | 0 241 162 | 10/1987 |
| EP | 0 456 523 | 11/1991 |
| EP | 0 672 462 | 9/1995 |
| EP | 1 250 963 | 10/2002 |
| FR | 2 674 773 | 10/1992 |

OTHER PUBLICATIONS

"MACH 2SL Hydraulically-Assisted HVLP Spray Gun", parts sheet, Binks, Jan. 2001, 12 pages.

"Automatic Air-Assisted Spray Gun", Instructions-Parts List, Graco, 2002, 32 pages.

* cited by examiner

AUTOMATIC AIR-ASSISTED MANIFOLD MOUNTED GUN

CROSS-REFERENCE TO RELATED APPLICATIONS

This application is a divisional of U.S. Ser. No. 10/366,251, filed Feb. 13, 2003 now U.S. Pat. No. 6,874,708 and titled AUTOMATIC AIR-ASSISTED MANIFOLD MOUNTED GUN. The disclosure of U.S. Ser. No. 10/366,251 is hereby incorporated herein by reference.

FIELD OF THE INVENTION

This invention relates to coating material atomizing and dispensing devices. It is disclosed in the context of an atomizer which uses (a) stream(s) of compressed gas or mixture of gases (hereinafter sometimes collectively "air") to shape the cloud of atomized material, sometimes referred to as an air-assisted, airless atomizer, or use (a) stream(s) of air to aid in atomization of the material to be atomized. However, it is believed to be useful in other applications as well.

BACKGROUND OF THE INVENTION

Various types of atomizers are known. There are, for example, the devices illustrated and described in U.S. Pat. No. 6,378,783, U.S. Pat. No. 6,276,616, Binks MACH 2A Hydraulically-Assisted Automatic HVLP Spray Gun Part Sheet, 2000, and Graco, Circulating, High Pressure Automatic Air-Assisted Spray Gun Instructions-Parts List, 1998. Various types of nozzles, air caps and the like for atomizers are also known. There are, for example, the devices illustrated and described in U.S. Pat. Nos. 5,344,078; 4,842,203; and, 4,386,739. This listing is not intended to be a representation that a complete search of all relevant art has been made, or that no more pertinent art than that listed exists, or that the listed art is material to patentability. Nor should any such representation be inferred.

As used herein, words such as "top," "bottom," "front," "rear," "left side," "right side," and the like refer to relative positions of components, devices and so on in the drawings, and are not intended as limitations on apparatus constructed according to the invention, orientations that apparatus constructed according to the invention can assume, or orientations in which such apparatus may be mounted. Nor should any such limitations be inferred.

DISCLOSURE OF THE INVENTION

According to one aspect of the invention, a coating material dispensing device includes a first component providing a connection to a source of coating material to be dispensed and a filter for filtering coating material to be dispensed. The first component includes a housing for housing the filter and a closure for selectively closing the housing to permit removal and replacement of the filter. The coating material dispensing device further includes a second component providing a nozzle through which the coating material is dispensed. The first and second components include first and second passageways, respectively. The first and second passageways communicate when the first and second components are assembled together to provide a flow of filtered coating material from the filter to the nozzle.

Illustratively according to this aspect of the invention, the first component includes separate first and second portions.

The first portion of the first component includes the housing, the closure and the first passageway. The second portion of the first component includes a control port for controlling a valve between the first passageway and the nozzle. The valve controls the flow of coating material from the nozzle.

Further illustratively according to this aspect of the invention, the first and second portions of the first component are constructed from different materials.

Additionally illustratively according to this aspect of the invention, the second component includes separate first and second portions. The first portion of the second component includes the second passageway and the nozzle. The second portion of the second component includes a mechanism for operating the valve.

Illustratively according to this aspect of the invention, the first and second portions of the second component are constructed from different materials.

Further illustratively according to this aspect of the invention, the second component includes a mechanism for operating a first valve between the first passageway and the nozzle. The first valve controls the flow of coating material from the nozzle. The dispensing device includes a port for the introduction of a stream of compressed gas or mixture of gases into the stream of coating material dispensed from the nozzle. A third passageway supplies the stream of compressed gas or mixture of gases to the nozzle. A second valve controls the supply of compressed gas or mixture of gases from the port to the nozzle. The second valve is coupled to the mechanism for operating the first valve to be controlled by the mechanism for operating the first valve.

Additionally illustratively according to this aspect of the invention, the port is provided in the first component and the third passageway is provided in the second component. The apparatus further includes a fourth passageway provided in the first component and coupling the third passageway to the port.

Illustratively according to this aspect of the invention, the control port for controlling the valve comprises a port for introducing into the apparatus an operating fluid for operating the valve.

Further illustratively according to this aspect of the invention, the second component includes a mechanism for operating a first valve between the first passageway and the nozzle. The first valve controls the flow of coating material from the nozzle. The dispensing device includes a port for the introduction of multiple streams of compressed gas or mixture of gases into the stream of coating material dispensed from the nozzle. A third passageway supplies at least one of the multiple streams of compressed gas or mixture of gases to the nozzle. A second valve controls the supply of compressed gas or mixture of gases from the port to the nozzle.

Illustratively according to this aspect of the invention, the second valve is coupled to the mechanism for operating the first valve to be controlled by the mechanism for operating the first valve. A fourth passageway supplies at least another of the multiple streams of compressed gas or mixture of gases to the nozzle. A third valve controls the supply of compressed gas or mixture of gases to the fourth passageway. The third valve is continuously adjustable to vary the amount of compressed gas or mixture of gases supplied through the fourth passageway.

According to another aspect of the invention, an air cap is provided for retaining first means for providing a coating material dispensing orifice. The air cap includes a plurality of pairs of first passageways. The passageways of each pair of first passageways are oriented on opposite sides of the orifice to direct streams of compressed gas or mixture of gases onto the opposite sides of the first means to reduce the buildup of coating material on the first means.

Illustratively according to this aspect of the invention, the apparatus includes at least three pairs of first passageways. A plane defined by intersecting lines extending longitudinally through the passageways of each pair of first passageways makes an angle of from about 20° to about 60° with a plane defined by intersecting lines extending longitudinally through the passageways of an adjacent pair of first passageways.

Illustratively according to this aspect of the invention, a plane defined by intersecting lines extending longitudinally through the passageways of each pair of first passageways makes an angle of from about 30° to about 50° with a plane defined by intersecting lines extending longitudinally through the passageways of an adjacent pair of first passageways.

Illustratively according to this aspect of the invention, a plane defined by intersecting lines extending longitudinally through the passageways of each pair of first passageways makes an angle of from about 40° with a plane defined by intersecting lines extending longitudinally through the passageways of an adjacent pair of first passageways.

Further illustratively according to this aspect of the invention, the apparatus includes at least one pair of second passageways. The second passageways of the at least one pair of second passageways are oriented on opposite sides of the orifice to direct streams of compressed gas or mixture of gases toward opposite sides of the stream of coating material dispensed through said coating material dispensing orifice to aid in atomization of coating material dispensed through the orifice.

Illustratively according to this aspect of the invention, the at least one pair of second passageways includes at least one pair of second passageways whose longitudinal directions make angles of from about 40° to about 80° with the stream of coating material being dispensed through the orifice.

Illustratively according to this aspect of the invention, the longitudinal directions of the at least one pair of second passageways make angles of from about 50° to about 70° with the stream of coating material being dispensed through the orifice.

Illustratively according to this aspect of the invention, the longitudinal directions of the at least one pair of second passageways make angles of about 60° with the stream of coating material being dispensed through the orifice.

Illustratively according to this aspect of the invention, the at least one pair of second passageways includes at least one pair of second passageways whose longitudinal directions extend generally perpendicularly to the stream of coating material being dispensed through the orifice.

Further illustratively according to this aspect of the invention, the apparatus includes at least one pair of third passageways. The passageways of each third pair of passageways are oriented on opposite sides of the orifice to direct streams of compressed gas or mixture of gases onto opposite margins of the stream of coating material dispensed from the coating material dispensing orifice.

According to another aspect of the invention, a coating material dispensing device includes a connection to a source of coating material to be dispensed, a nozzle through which the coating material is dispensed, and a first valve including a first valve component between the connection and the nozzle. The orientation of the first valve component controls the flow of coating material from the nozzle. The coating material dispensing device further includes a mechanism for changing the orientation of the first valve component. The mechanism and the first valve component are removable from the dispensing device as a unit.

Illustratively according to this aspect of the invention, the apparatus includes a connection to a source of compressed gas or mixture of gases for dispensing with the coating material, and a second valve for controlling the dispensing of compressed gas or mixture of gases with the coating material.

Illustratively according to this aspect of the invention, the second valve includes a component coupled to the mechanism. The condition of the second valve, that is, whether it is open or closed, is controlled by the mechanism.

Illustratively according to this aspect of the invention, the mechanism includes a piston and a cylinder in which the piston is reciprocable to move the first valve component to control the flow of coating material from the nozzle. The cylinder is closed by a closure. The first valve component and piston are removable from the coating material dispensing device by opening the closure and withdrawing the piston from the cylinder.

Illustratively according to this aspect of the invention, the second valve component is mounted to the piston for movement with the piston.

Illustratively according to this aspect of the invention, the second valve component is mounted to the piston from a closure side of the piston. This permits removal of the second valve component by removing the closure and removing the second valve component without having to remove the piston from the cylinder.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
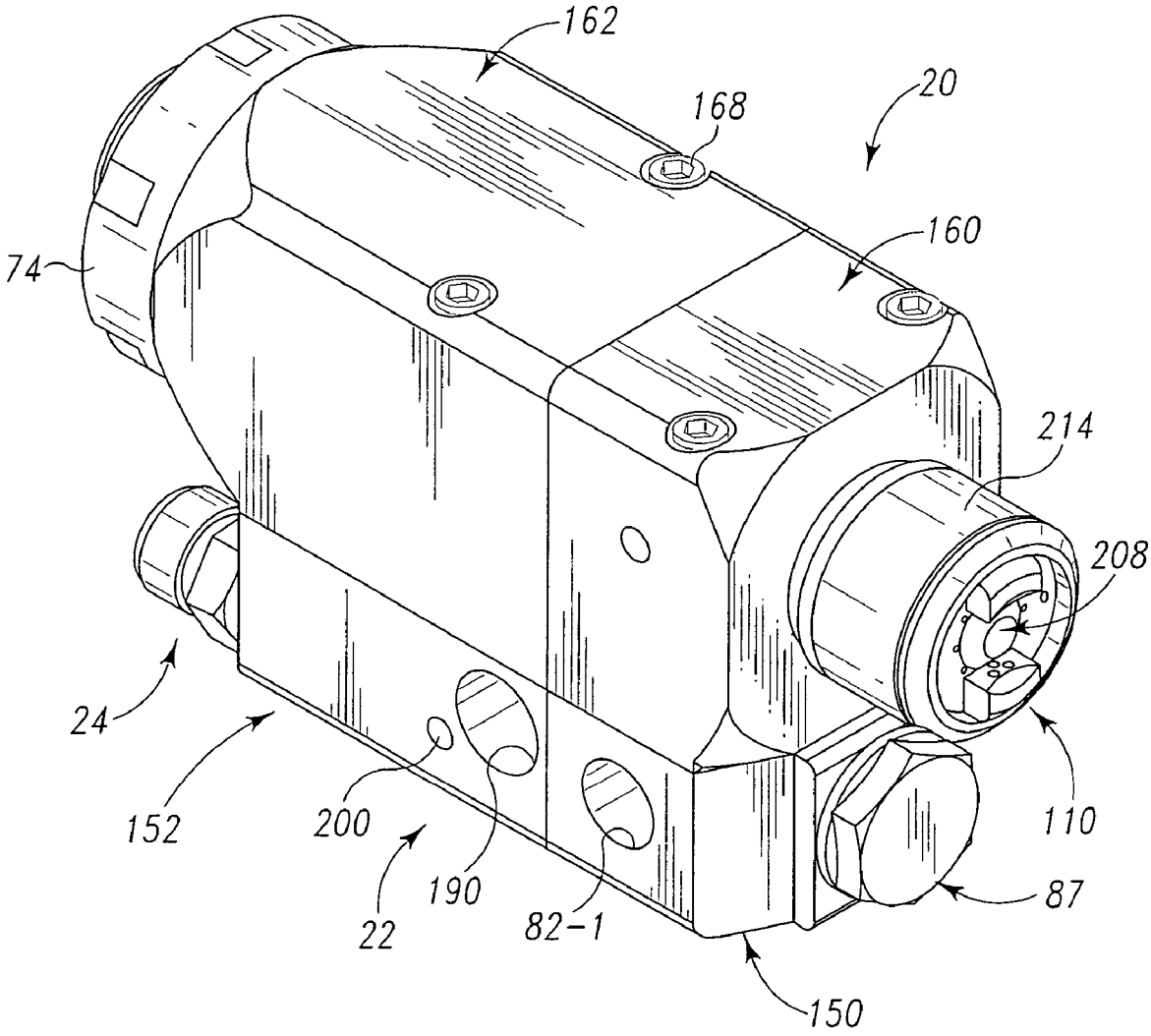
FIG. 1 illustrates a perspective view of an apparatus constructed according to the present invention.
Figure 2:
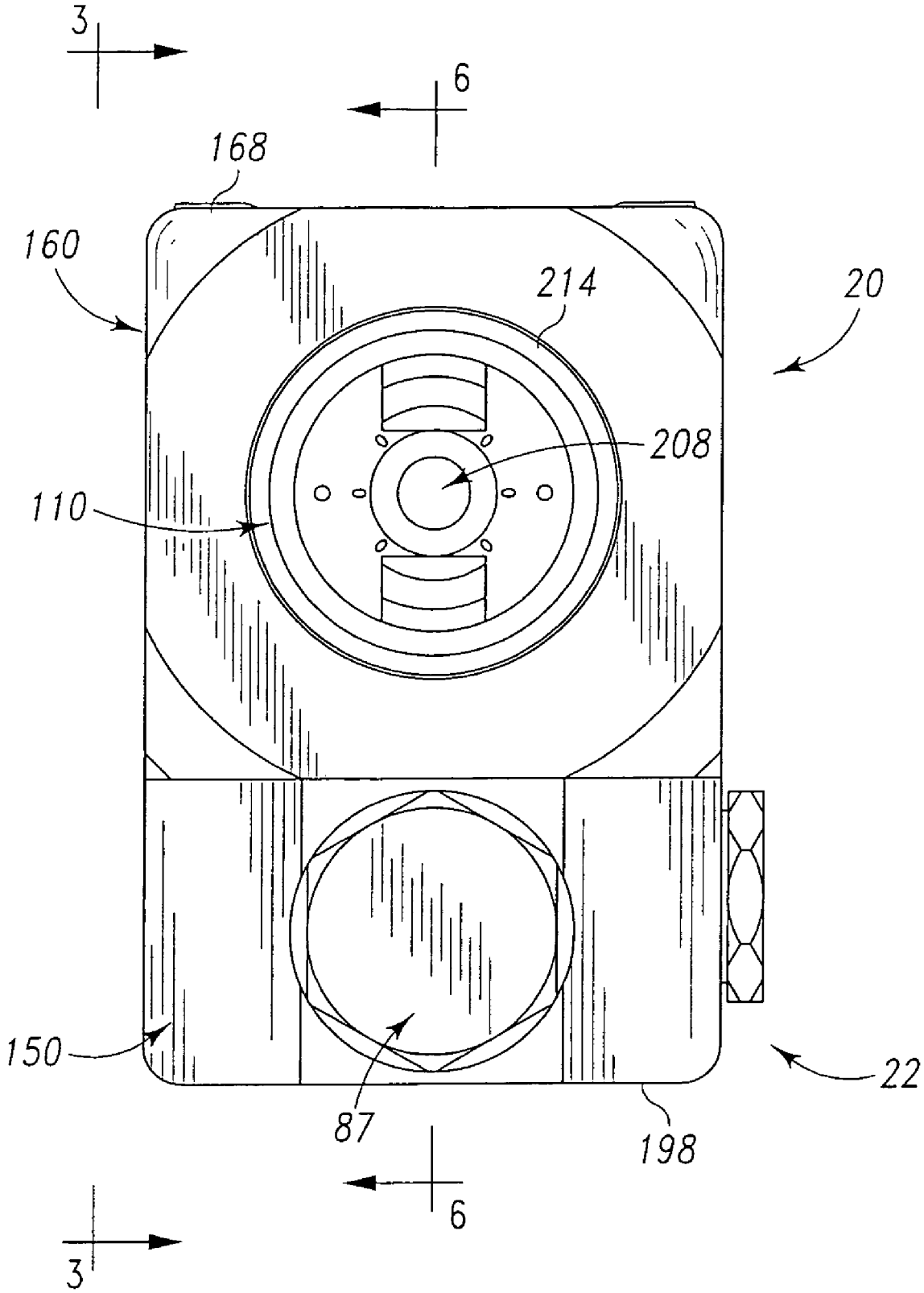
FIG. 2 illustrates a front elevational view of the apparatus illustrated in FIG. 1.
Figure 3:
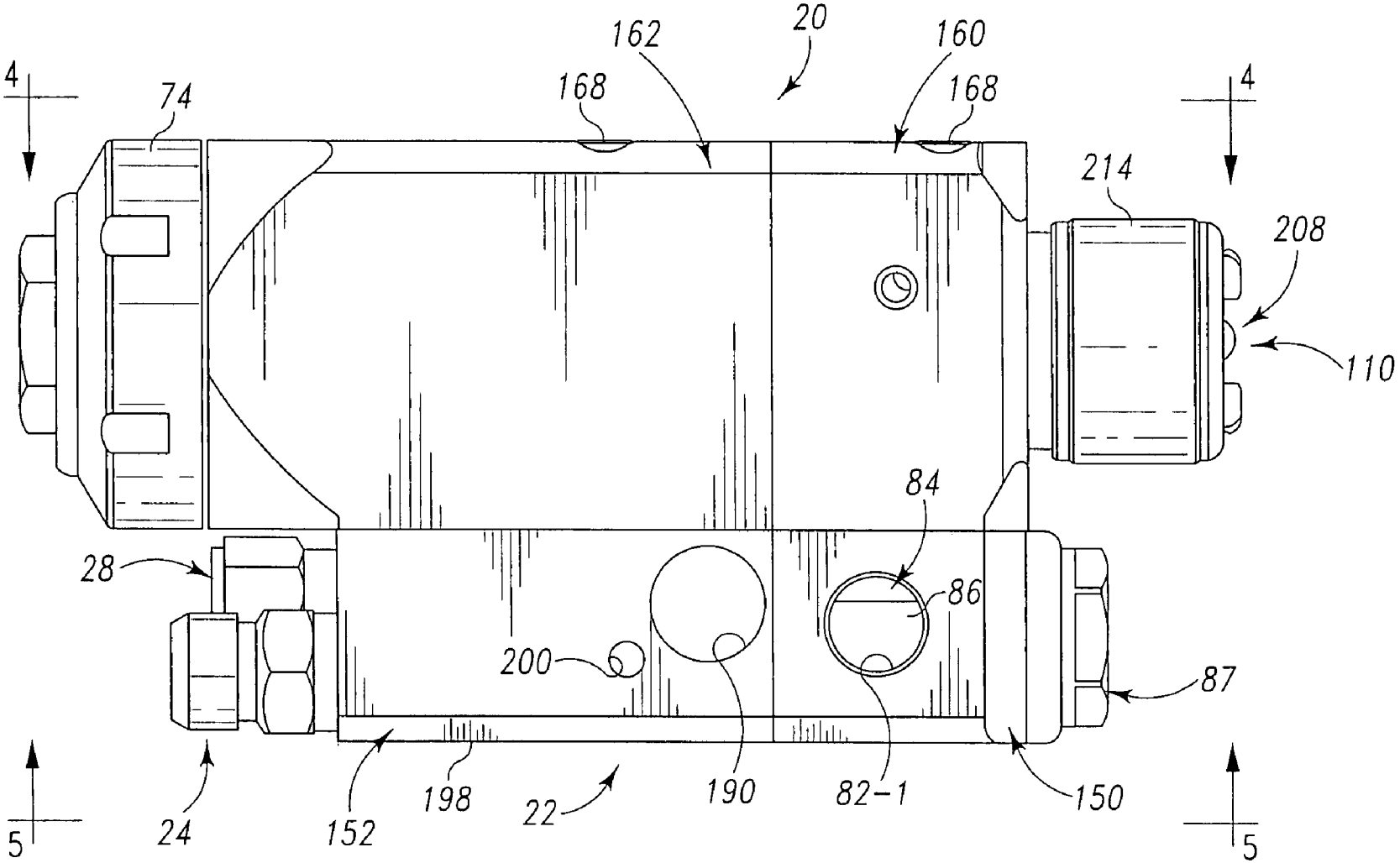
FIG. 3 illustrates a right side elevational view of the apparatus illustrated in FIGS. 1–2, taken generally along section lines 3—3 of FIG. 2.
Figure 4:
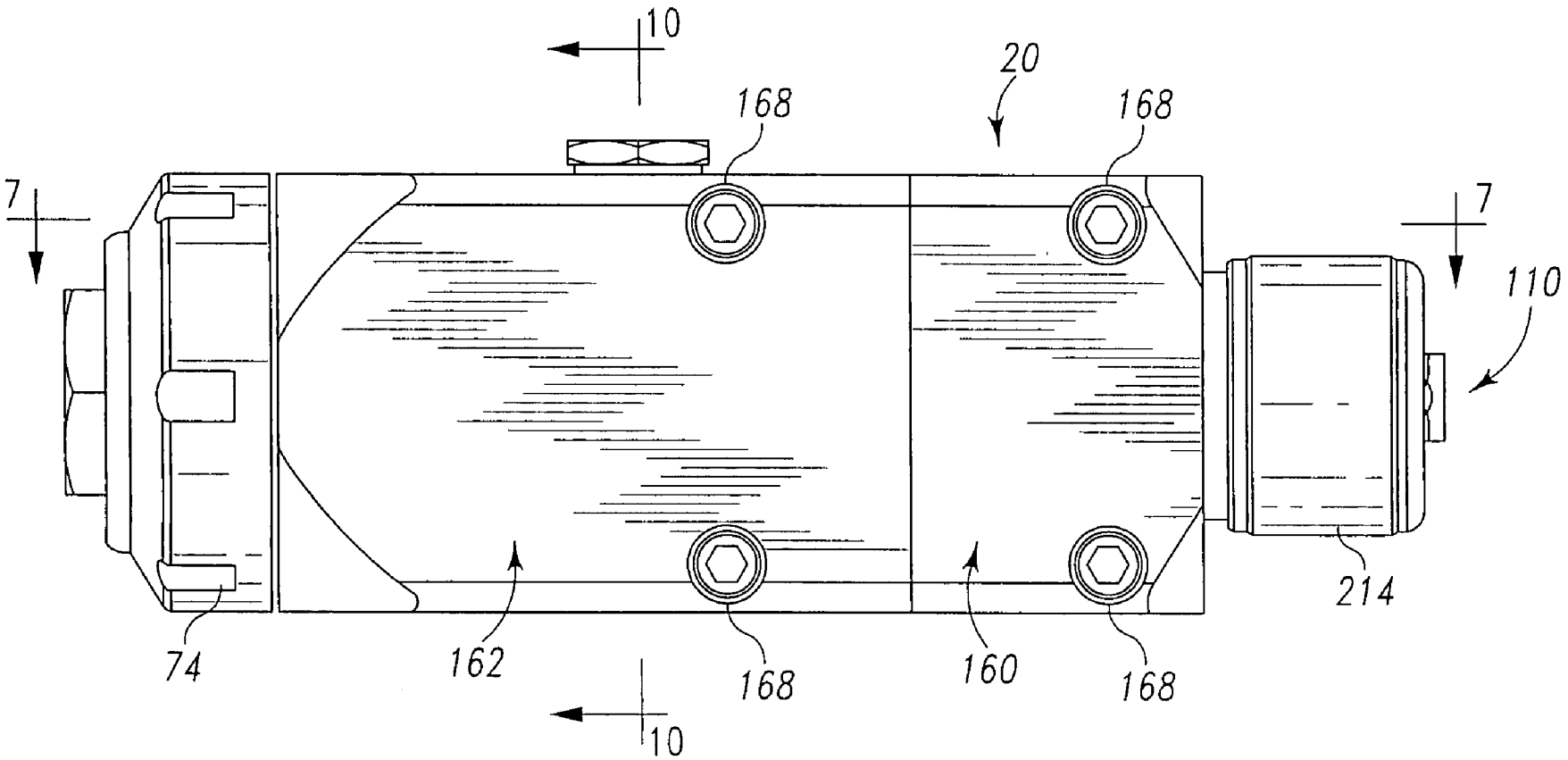
FIG. 4 illustrates a top plan view of the apparatus illustrated in FIGS. 1–3, taken generally along section lines 4—4 of FIG. 3.
Figure 5:
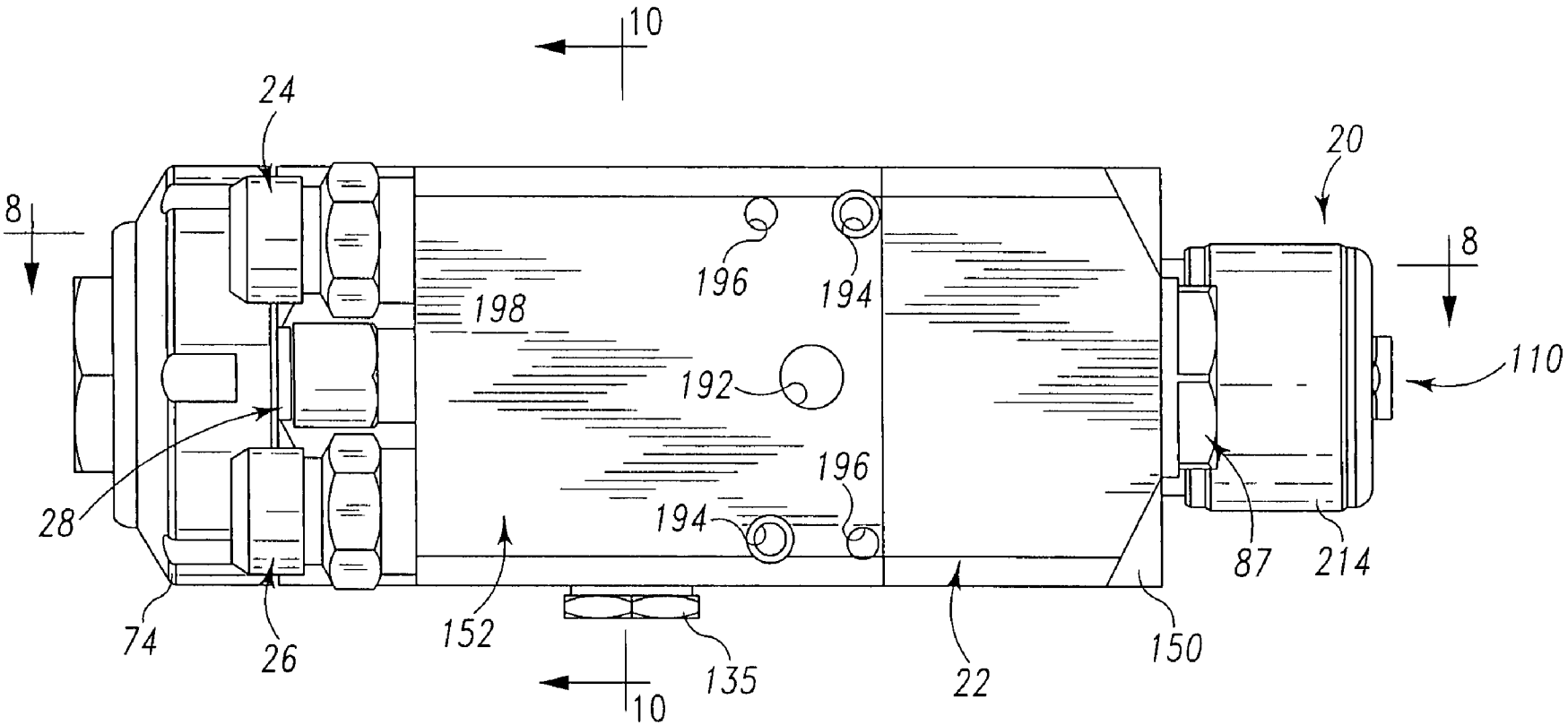
FIG. 5 illustrates a bottom plan view of the apparatus illustrated in FIGS. 1–4, taken generally along section lines 5—5 of FIG. 3.

An automatic manifold mount gun 20 is capable of being used as an air-assisted hydraulic atomizer, or in a high-volume, low-pressure (hereinafter sometimes HVLP) applications. Gun 20 is mounted on an air/fluid inlet junction manifold 22. Manifold 22 provides inlet fittings 24, 26, 28 for atomizing air, spray pattern-shaping air (hereinafter sometimes "fan air"), and the air supply to the piston 34 and cylinder 36 (FIGS. 6–8) which operate the valve 38 (FIG. 6) which controls the flow of coating material from gun 20 (hereinafter sometimes "cylinder air"), respectively. Gun 20 generally produces a relatively flat, cat's-eye shaped, oval or elliptical cross section pattern with somewhat fan-shaped margins.

Figure 6:
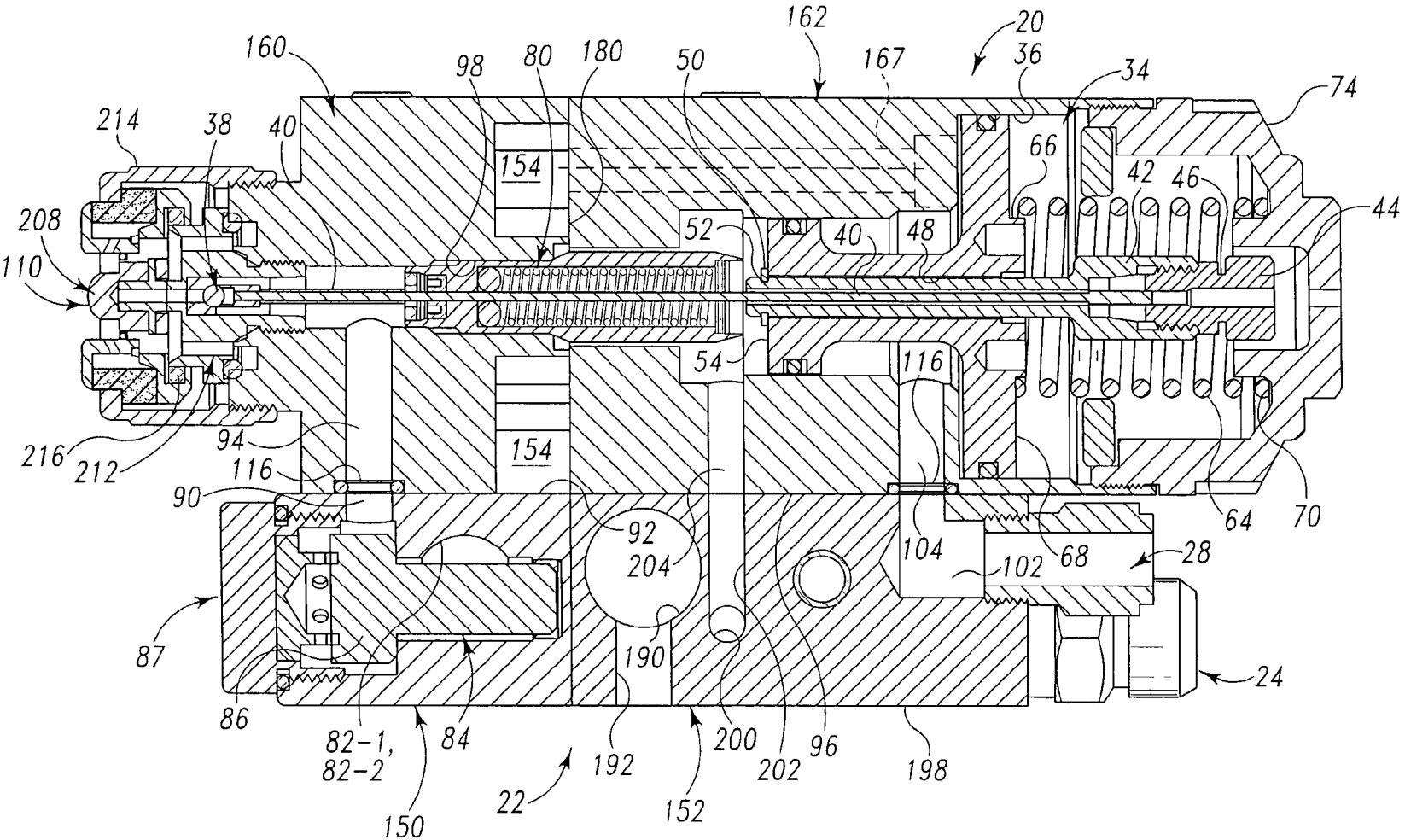
FIG. 6 illustrates a sectional view of the apparatus illustrated in FIGS. 1–5, taken generally along section lines 6—6 of FIG. 2.
Figure 7:
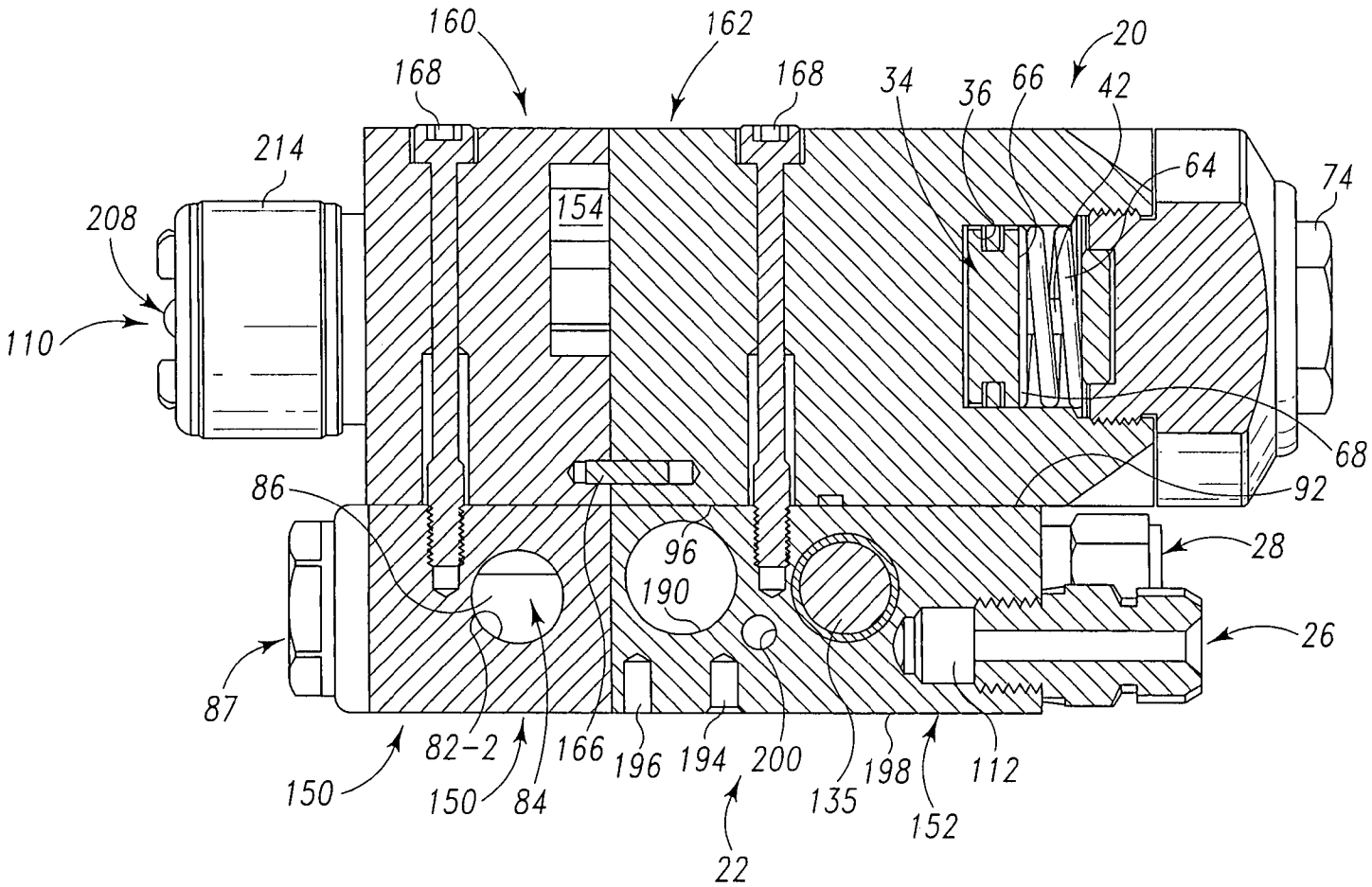
FIG. 7 illustrates a sectional view of the apparatus illustrated in FIGS. 1–6, taken generally along section lines 7—7 of FIG. 4.
Figure 8:
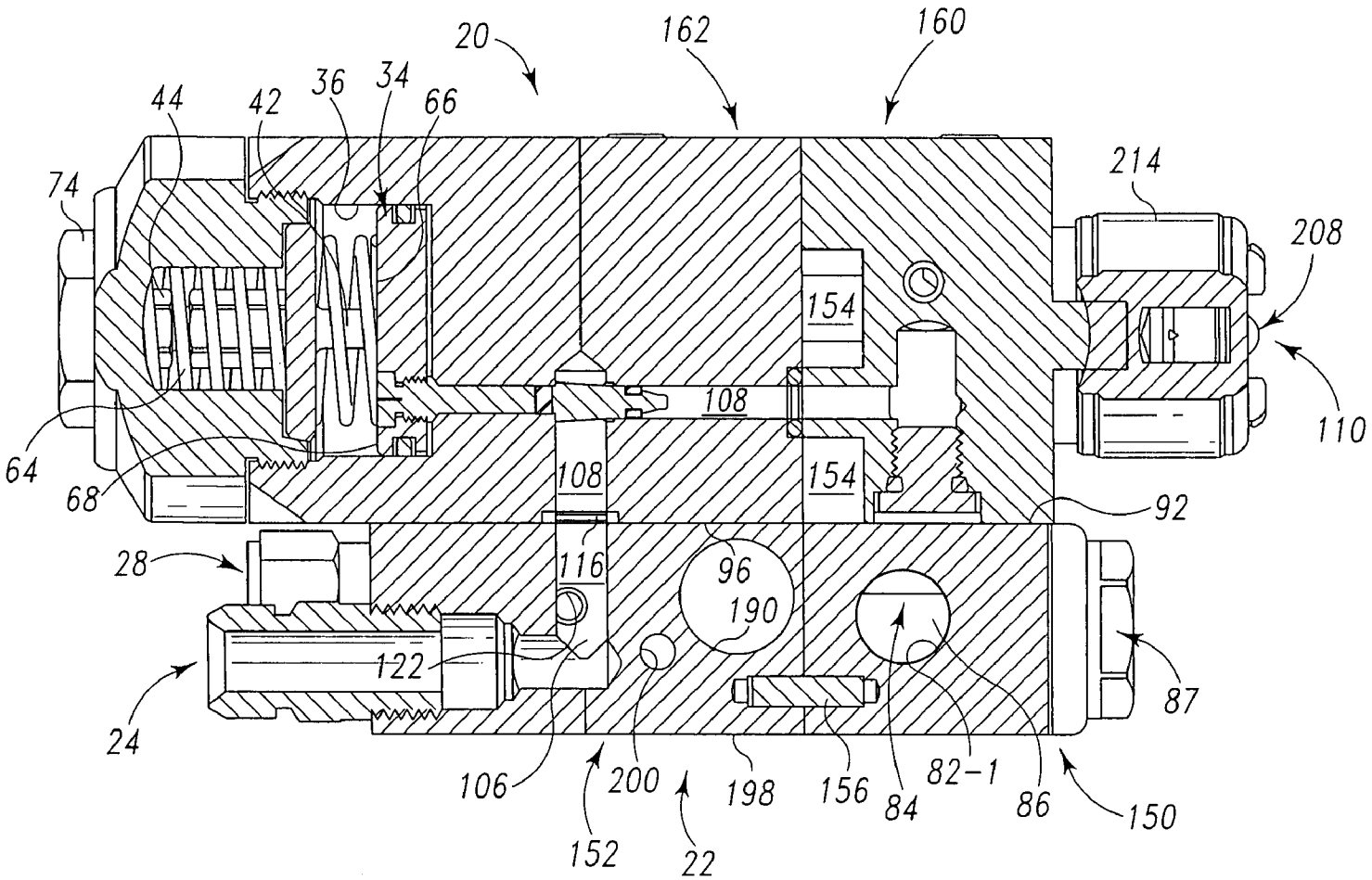
FIG. 8 illustrates a sectional view of the apparatus illustrated in FIGS. 1–7, taken generally along section lines 8—8 of FIG. 5.

Referring particularly to FIGS. 6–8, the piston 34 is reciprocable in the cylinder 36 at a rearward end of gun 20. Piston 34 controls the opening and closing of coating material valve 38 at a forward end of gun 20 through a stem 40. Stem 40 is held in place in relation to piston 34 by a collet 42 and a collet locknut 44 which is threaded into the rearward end 46 of collet 42 and grips stem 40, capturing stem 40 in collet 42. The collet 42 is positioned in a passageway 48 through piston 34 by a retaining ring 50 which snaps into a groove 52 provided therefor in the collet 42 stem at a front face 54 of piston 34. The piston 34 is yieldably urged forward in its cylinder 36 by a piston spring 64 which is captured between a spring seat 66 provided on a rearward face 68 of piston 34 and a spring seat 70 formed on the inside of a cylinder end cap 74. Stem 40 extends through a cartridge assembly 80 which provides a seal around stem 40. Cartridge assembly 80 is of the general type, and generally for the purposes, described in U.S. Pat. No. 6,272,616.

Coating material to be dispensed from gun 20 is provided through either of two ports 82-1, 82-2 provided in manifold 22. The other of ports 82-1, 82-2 can be plugged with a threaded plug (not shown), or coupled through (a) suitable conduit(s) (not shown) to another gun 20 to supply coating material thereto, to recirculate coating material to the coating material source, such as a paint kitchen, or the like. Ports 82-1, 82-2 intersect a filter chamber 84 internally within manifold 22. Filter chamber 84 houses a filter 86 for the material to be dispensed. The filter may be, for example, a 100 mesh edge filter such as a Binks part number 54-1836 filter. Filter 86 is held removably in gun 20 by a threaded filter retainer assembly 87.

Figure 10:
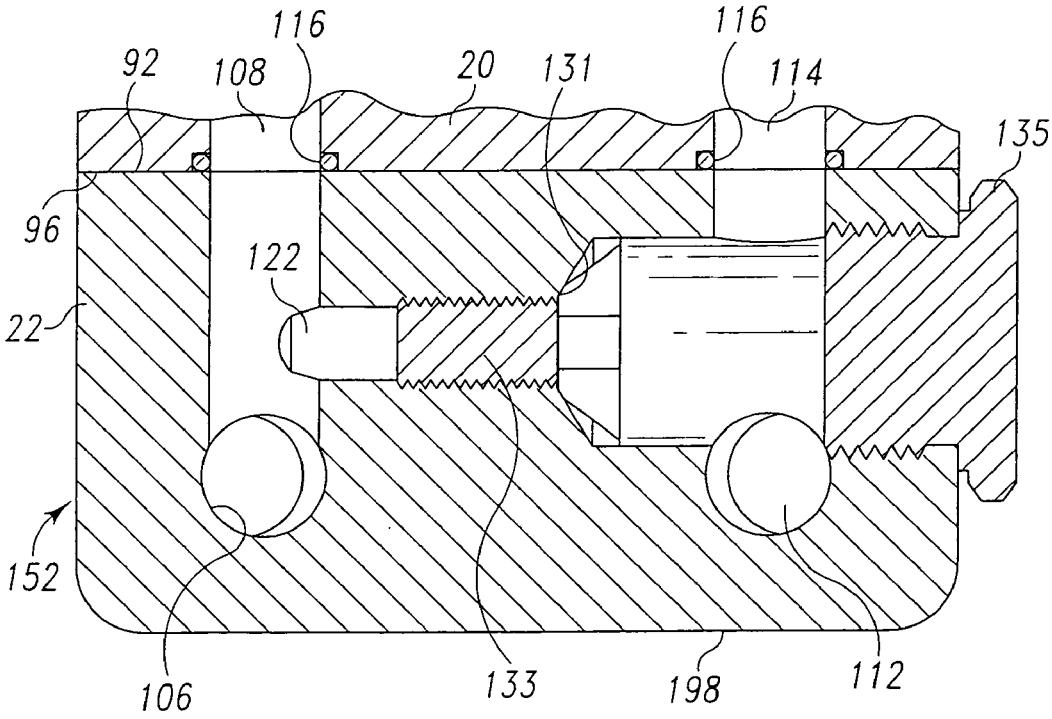
FIG. 10 illustrates an enlarged sectional view of a detail of another embodiment of the apparatus illustrated in FIGS. 1–8, taken generally along section lines 10—10 of FIGS. 4–5.
Figure 11:
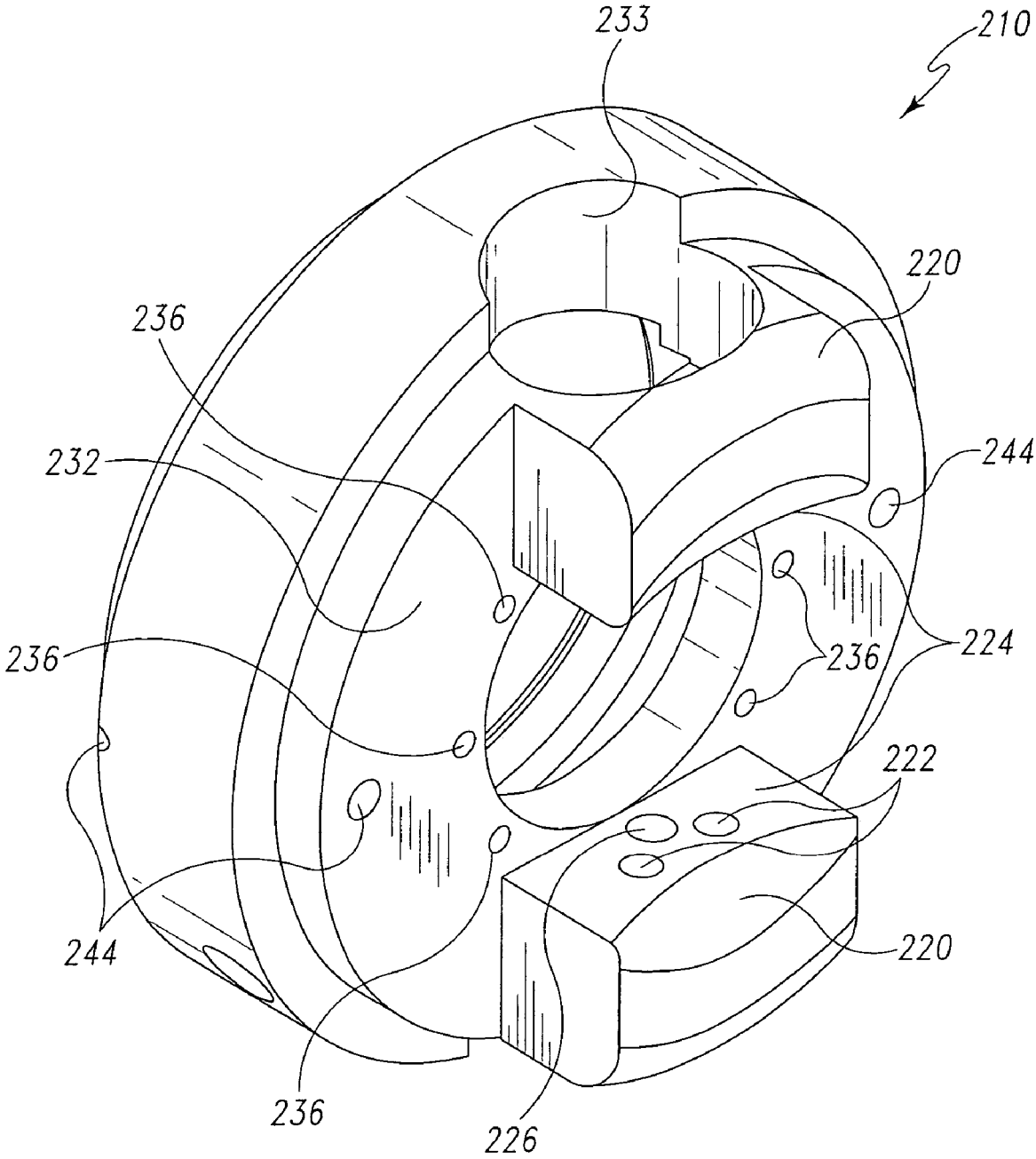
FIG. 11 illustrates an enlarged perspective view from the front and above of a detail of the apparatus illustrated in FIGS. 1–8.
Figure 12:
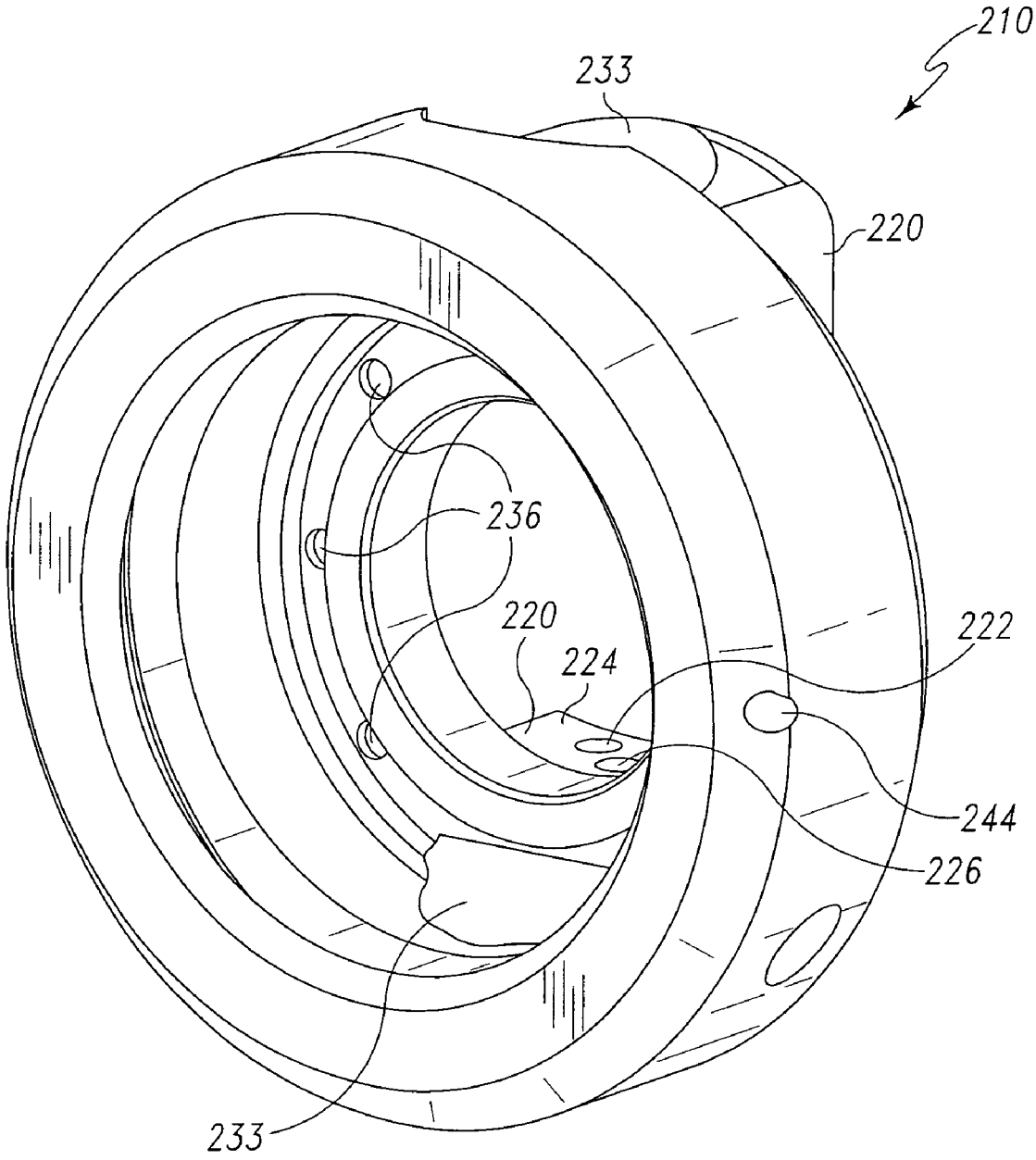
FIG. 12 illustrates a perspective view from the rear and above of the detail illustrated in FIG. 11.
Figure 13:
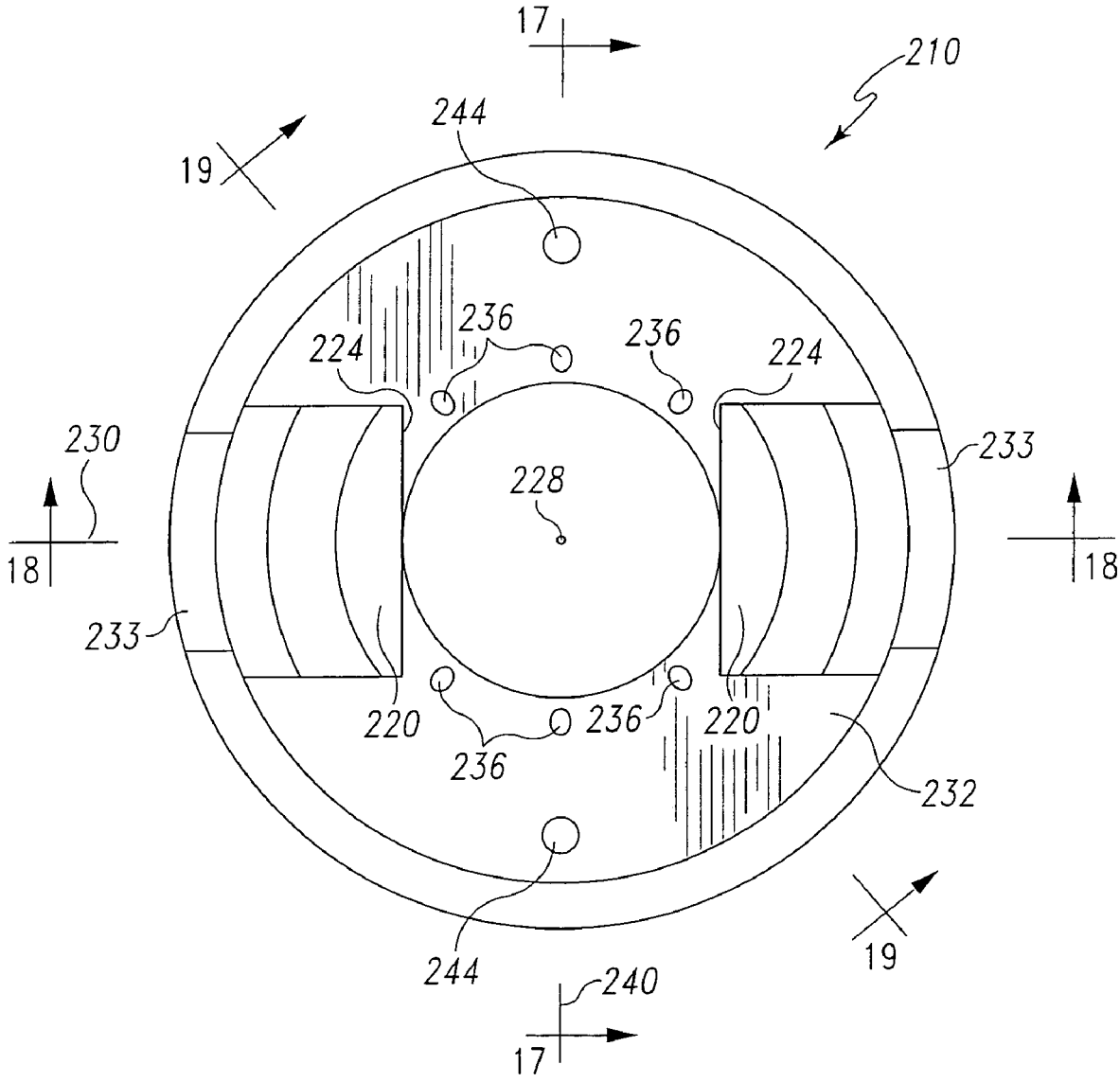
FIG. 13 illustrates a front elevational view of the detail illustrated in FIGS. 11–12.
Figure 14:
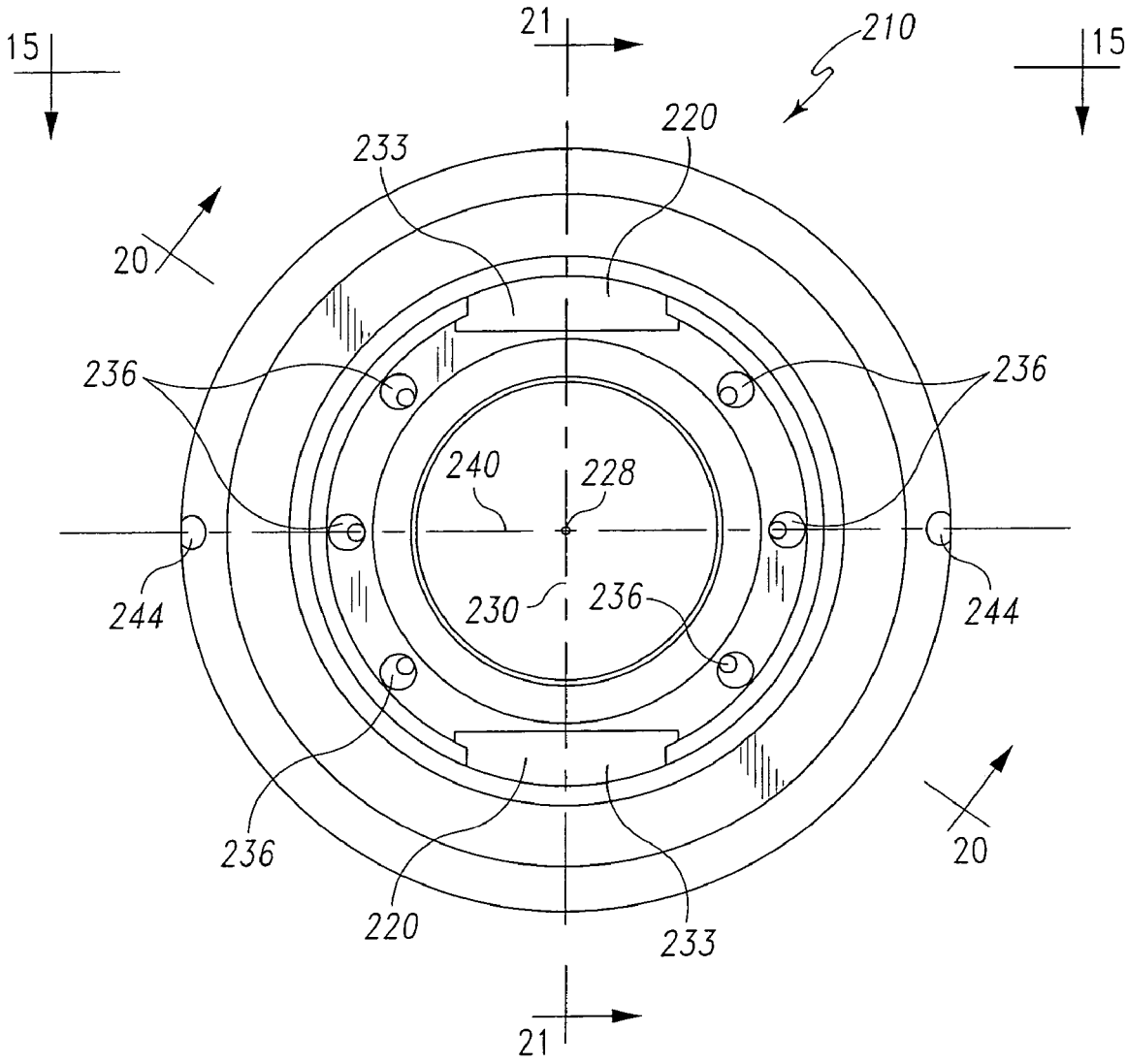
FIG. 14 illustrates a rear elevational view of the detail illustrated in FIGS. 11–13.
Figure 15:
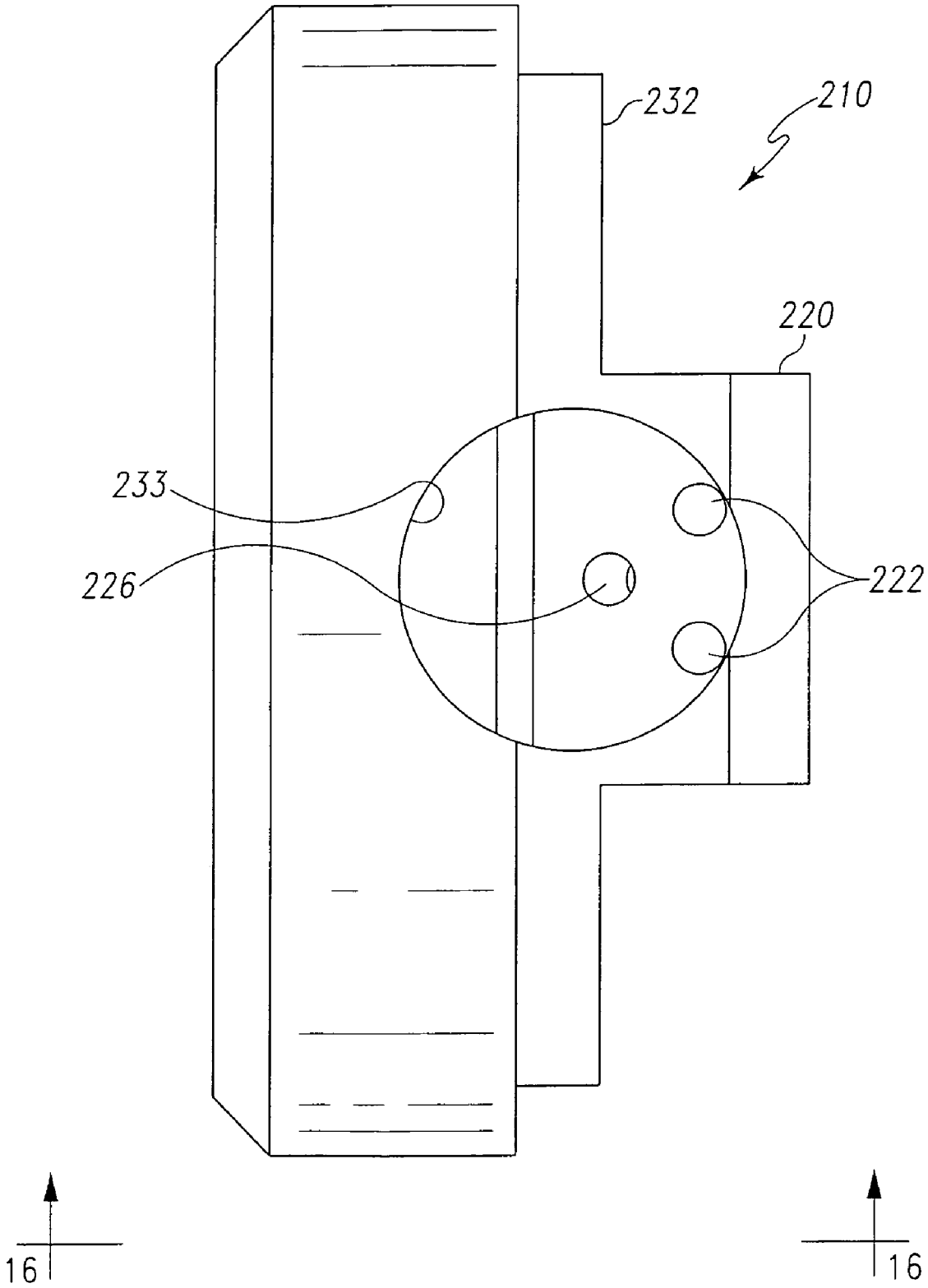
FIG. 15 illustrates a plan view of the detail illustrated in FIGS. 11–14, taken generally along section lines 15—15 of FIG. 14.
Figure 16:
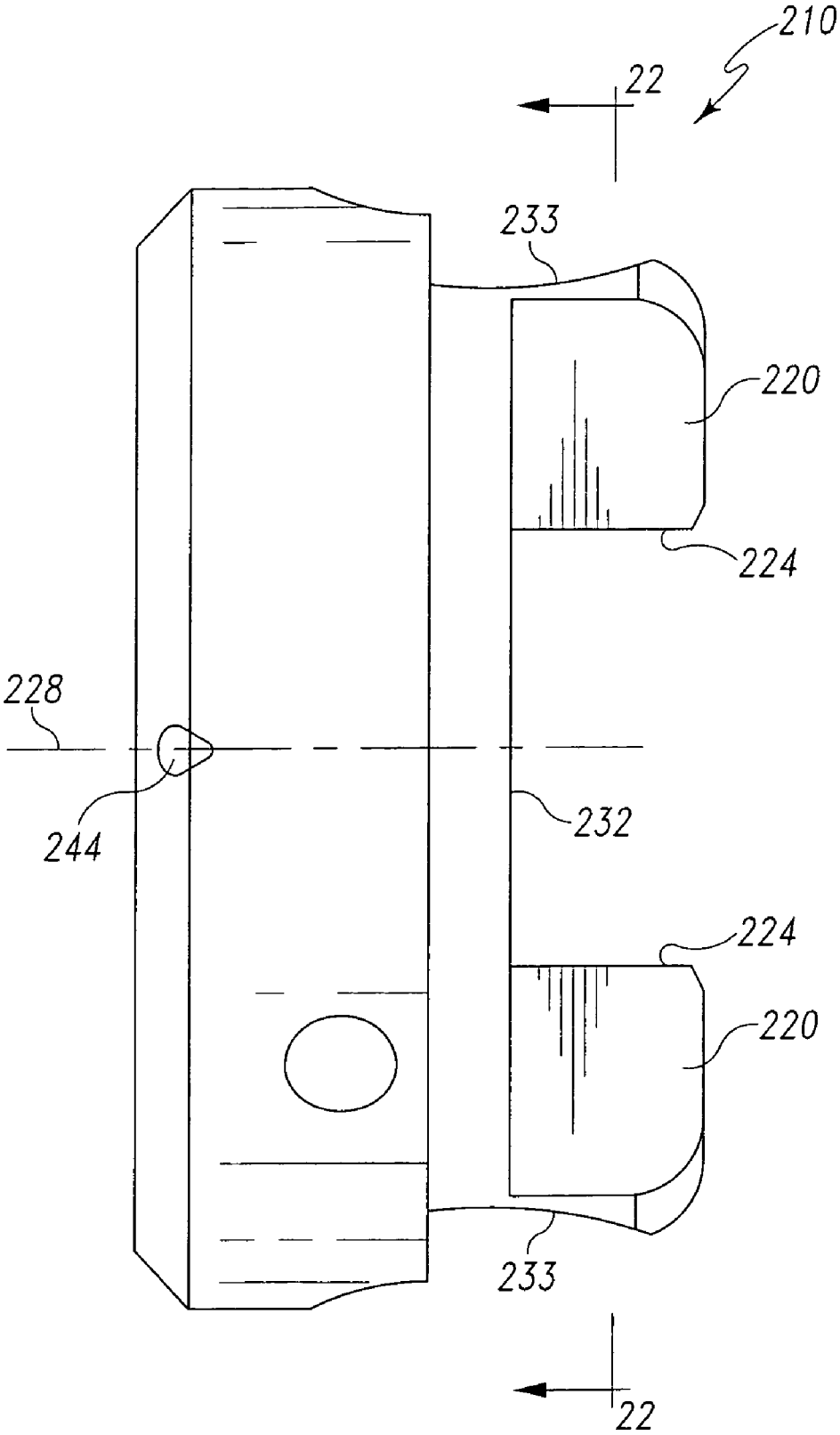
FIG. 16 illustrates a side elevational view of the detail illustrated in FIGS. 11–15, taken generally along section lines 16—16 of FIG. 15.
Figure 17:
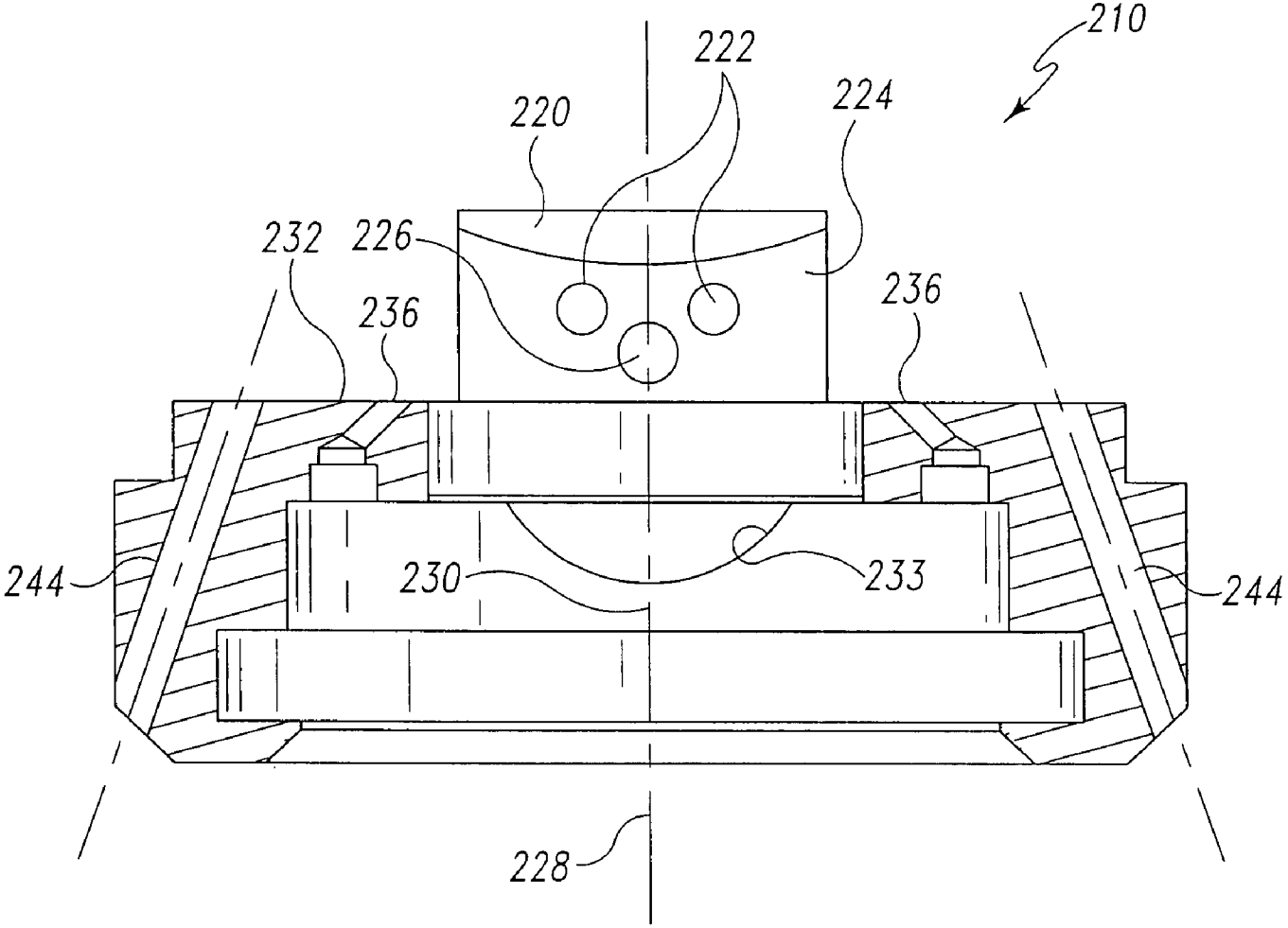
FIG. 17 illustrates a sectional view of the detail illustrated in FIGS. 11–16, taken generally along section lines 17—17 of FIG. 13.
Figure 18:
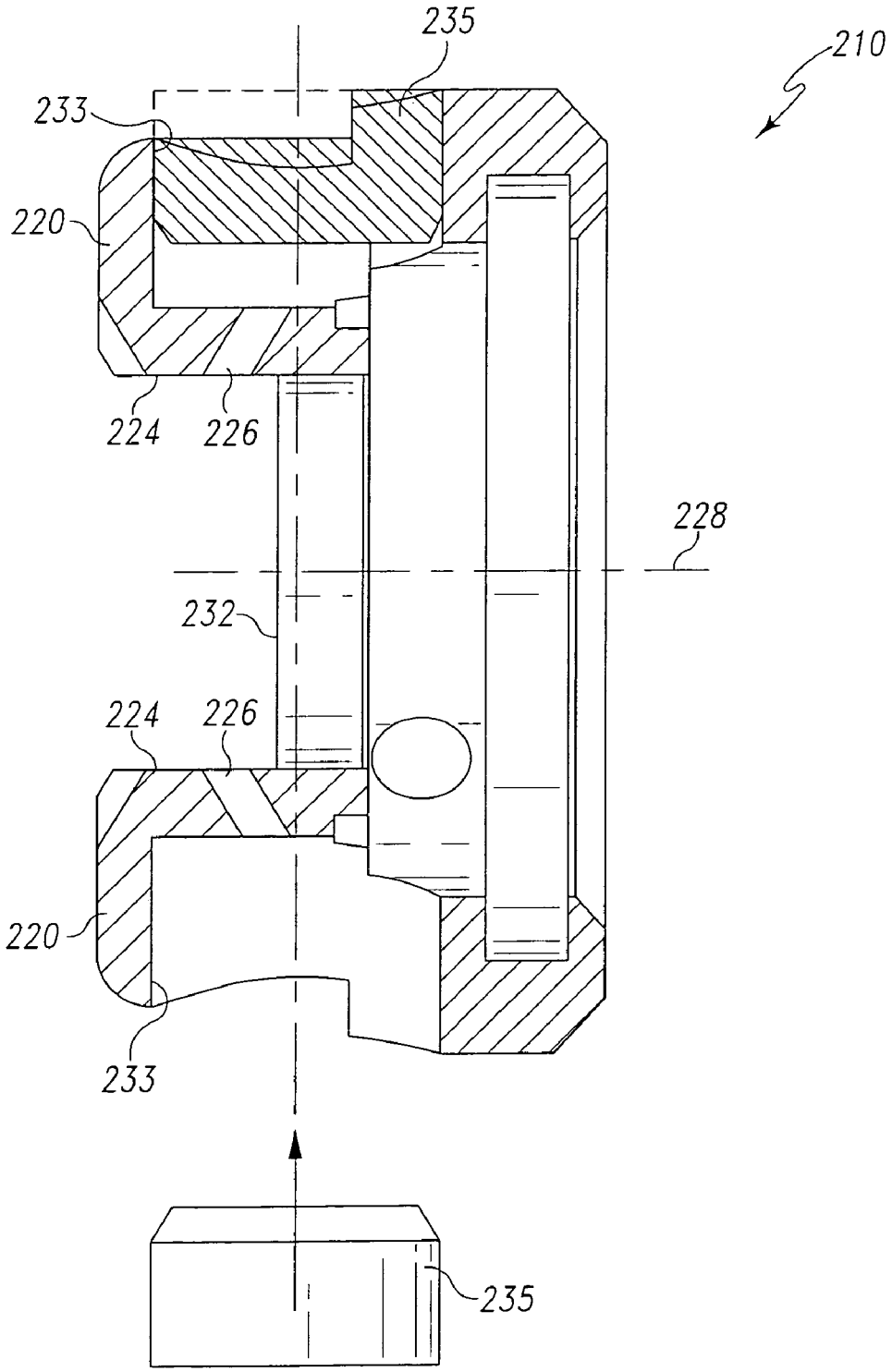
FIG. 18 illustrates an exploded sectional view of the detail illustrated in FIGS. 11–17, taken generally along section lines 18—18 of FIG. 13.
Figure 19:
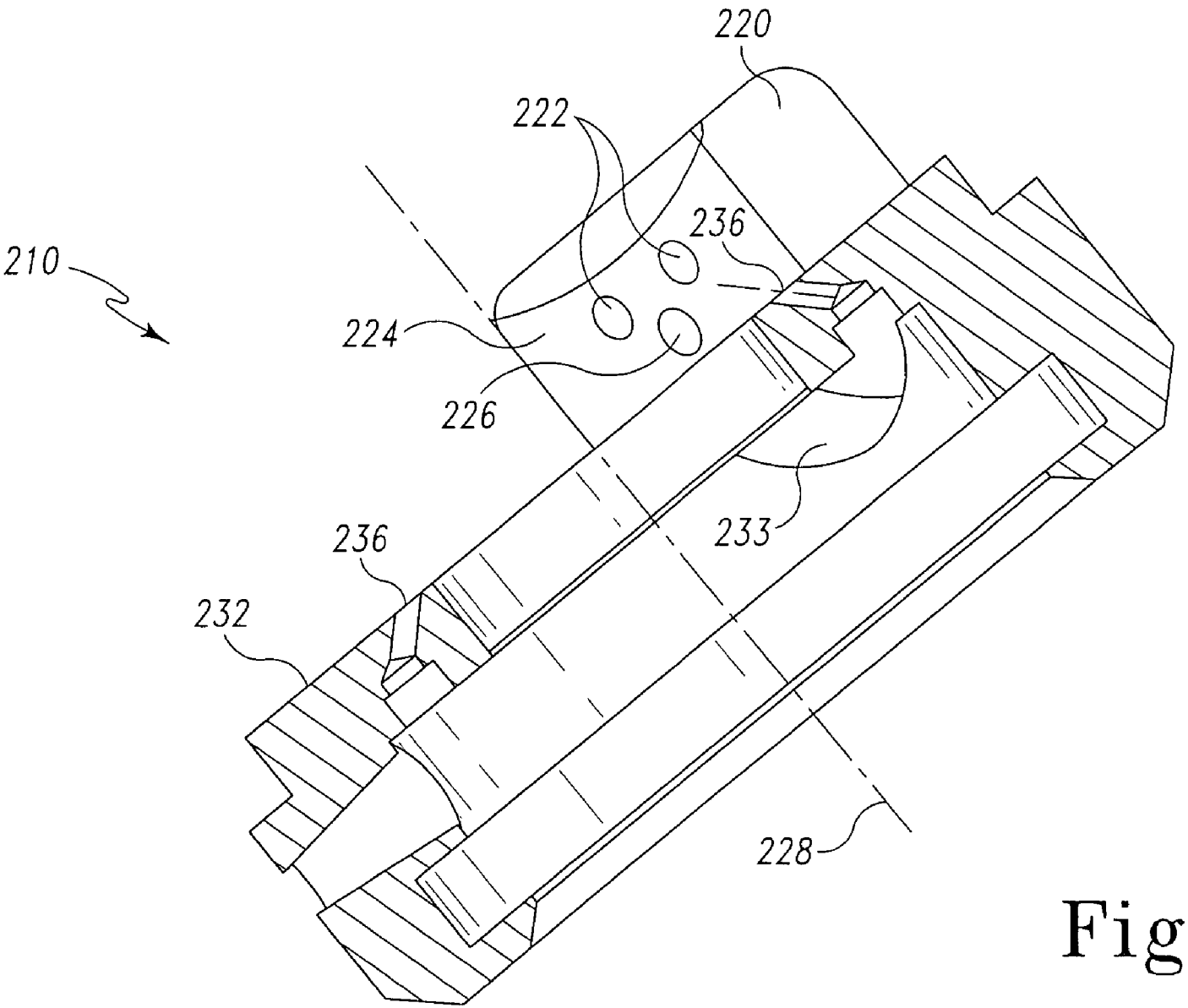
FIG. 19 illustrates a sectional view of the detail illustrated in FIGS. 11–18, taken generally along section lines 19—19 of FIG. 13.
Figure 20:
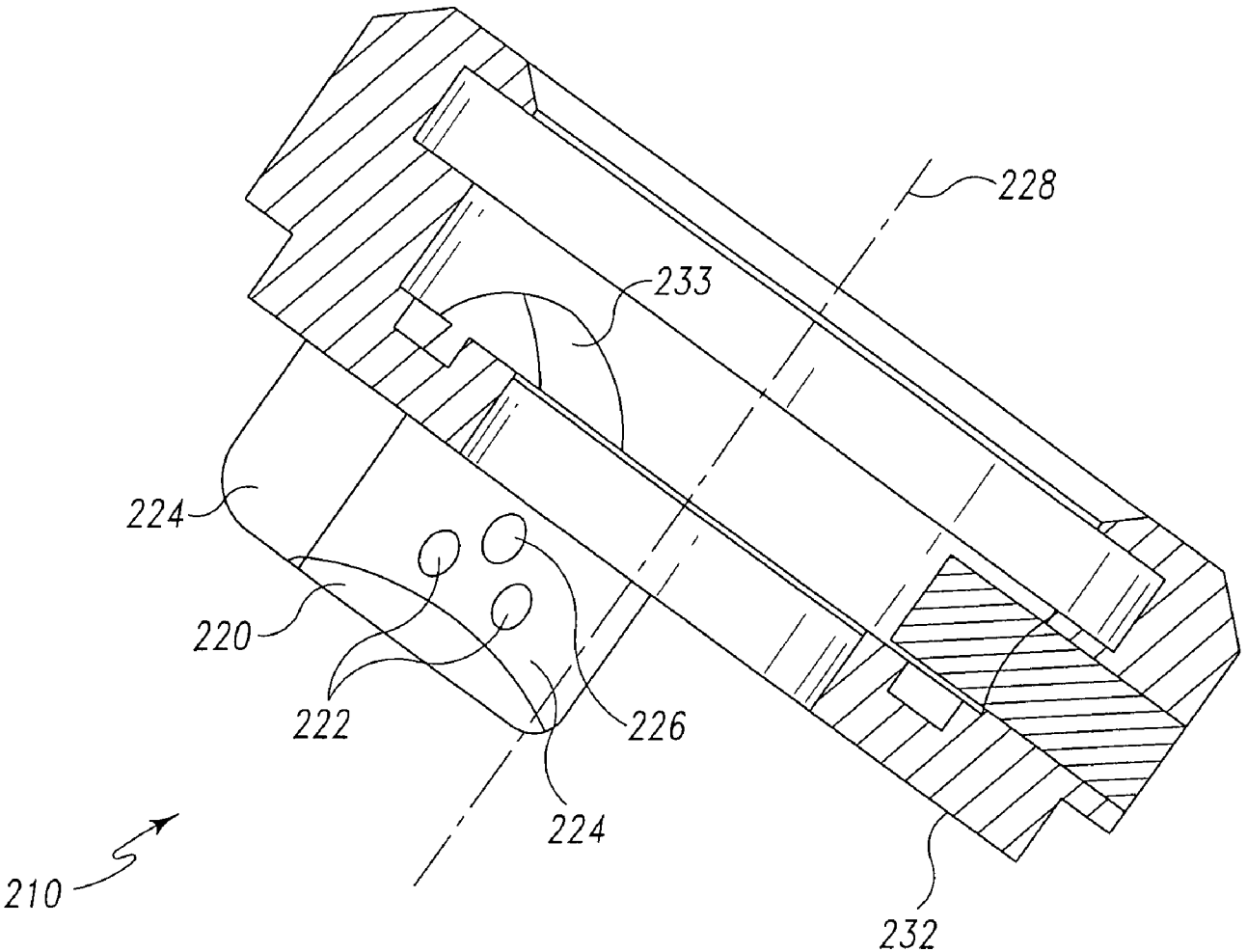
FIG. 20 illustrates a sectional view of the detail illustrated in FIGS. 11–19, taken generally along section lines 20—20 of FIG. 14.
Figure 21:
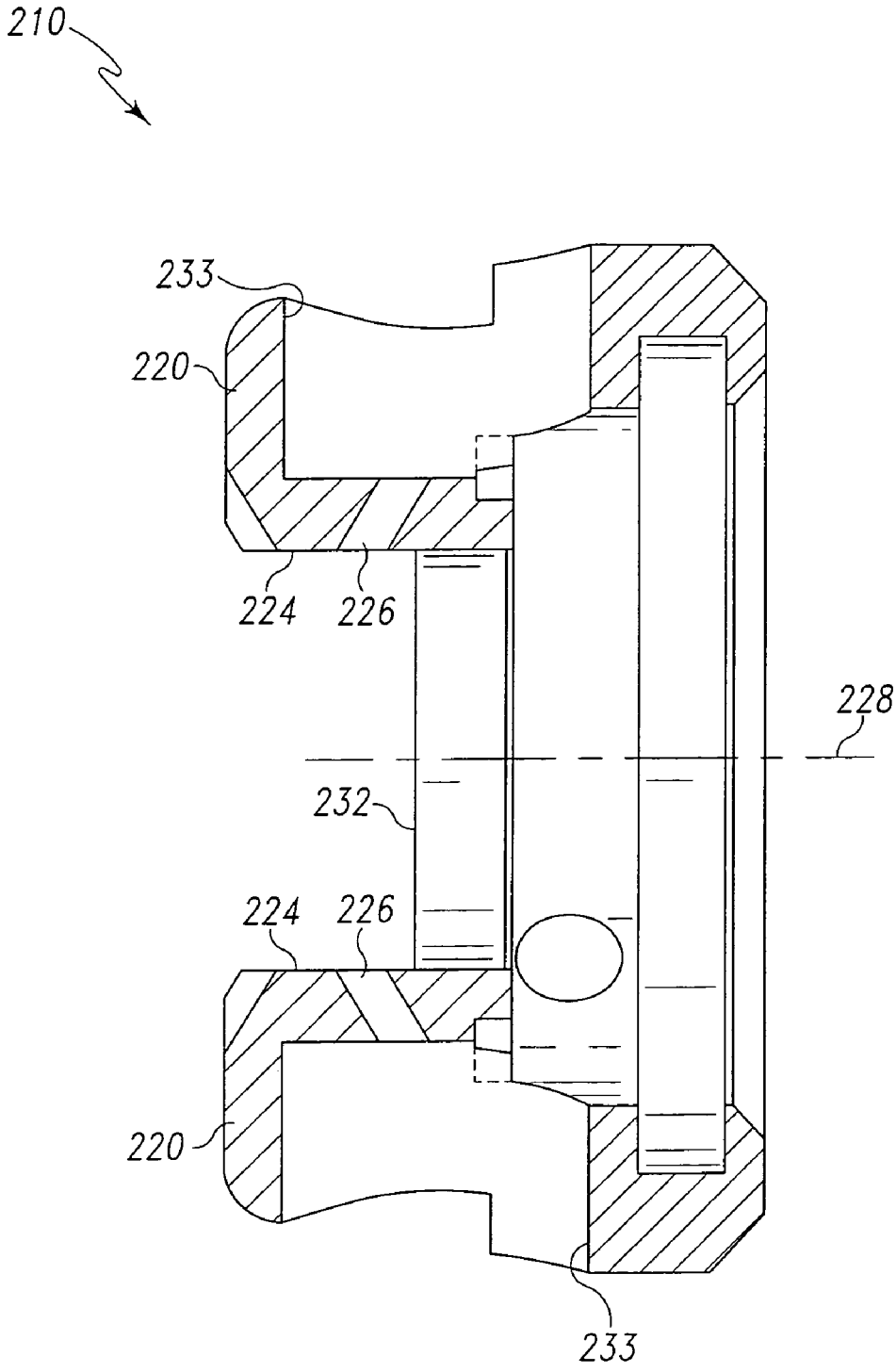
FIG. 21 illustrates a sectional view of the detail illustrated in FIGS. 11–20, taken generally along section lines 21—21 of FIG. 14.
Figure 22:
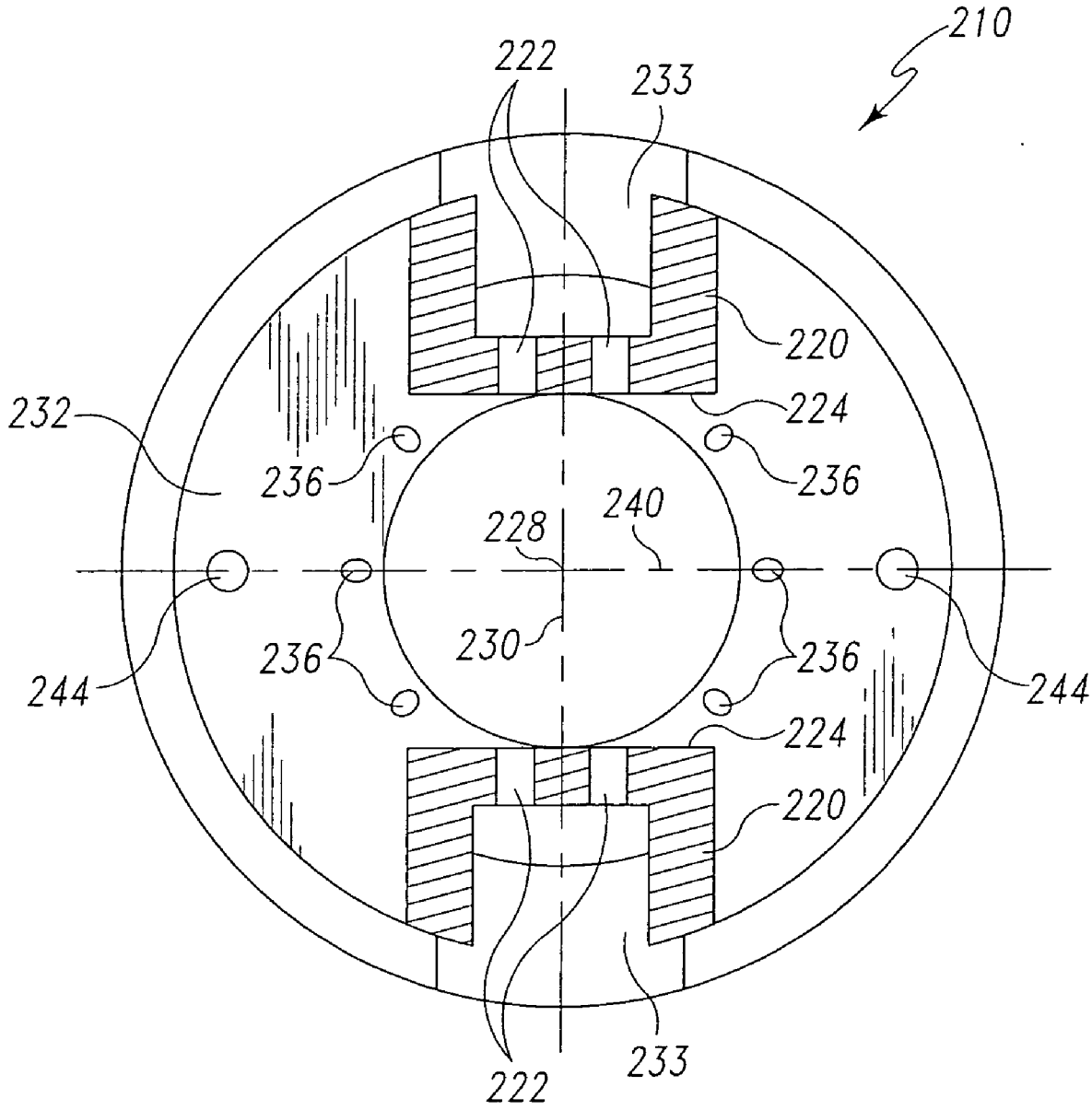
FIG. 22 illustrates a sectional view of the detail illustrated in FIGS. 11–21, taken generally along section lines 22—22 of FIG. 16.

A passageway 90 (FIG. 6) leads from filter chamber 84 to a surface 92 of manifold 22. A mating passageway 94 extends from a mating surface 96 of gun 20 and intersects a central passageway 98 which extends generally longitudinally of the body of gun 20. Passageway 94 intersects passageway 98 forward of cartridge assembly 80 which is threaded into passageway 98 from the cylinder 36 end of gun 20. A passageway 102 extends from cylinder air fitting 28 to surface 92 of manifold 22. A mating passageway 104 extends from surface 96 to cylinder 36 in front of a working surface of piston 34. A passageway 106 (FIGS. 8 and 10) extends from atomizing air fitting 24 to surface 92 of manifold 22. A mating passageway 108 extends from surface 96 to, for example, an air-assisted hydraulic atomizing nozzle/air cap 110 (hereinafter sometimes referred to collectively as a "nozzle") at the front of gun 20. A passageway 112 (FIGS. 7 and 10) extends from fan air fitting 26 to surface 92 of manifold 22. A mating passageway 114 (FIG. 10) extends from surface 96 to nozzle 110. Suitable seals 116, such as, for example, O-ring seals of materials suitably inert to the materials flowing through them, are provided at the mating surfaces 92, 96 around passageways 90, 94; 102, 104; 106, 108; and 112, 114 to seal these passageways against leakage.

Figure 23:
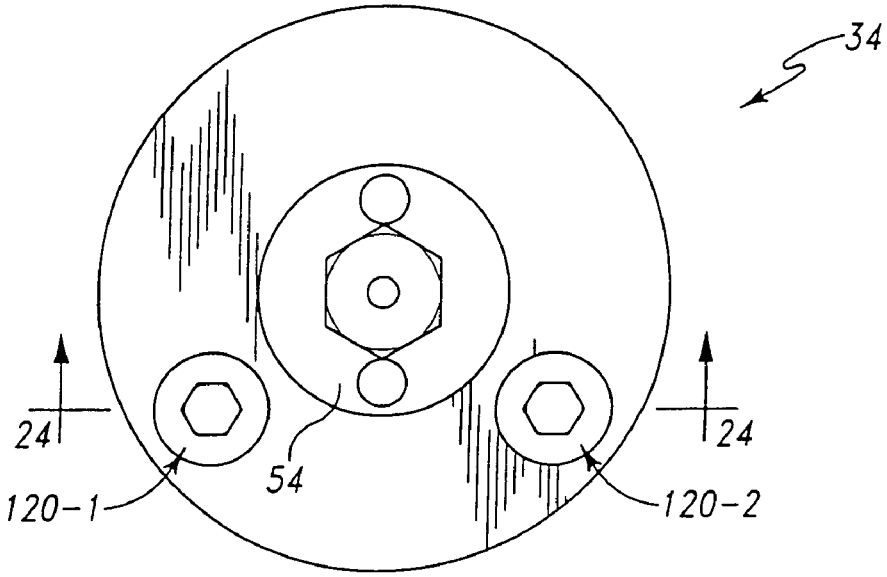
FIG. 23 illustrates a front elevational view of another embodiment of a detail of the apparatus illustrated in FIGS. 1–10; and, FIG. 24 illustrates a sectional view of the detail illustrated in FIG. 23, taken generally along section lines 24—24 of FIG. 23.
Figure 24:
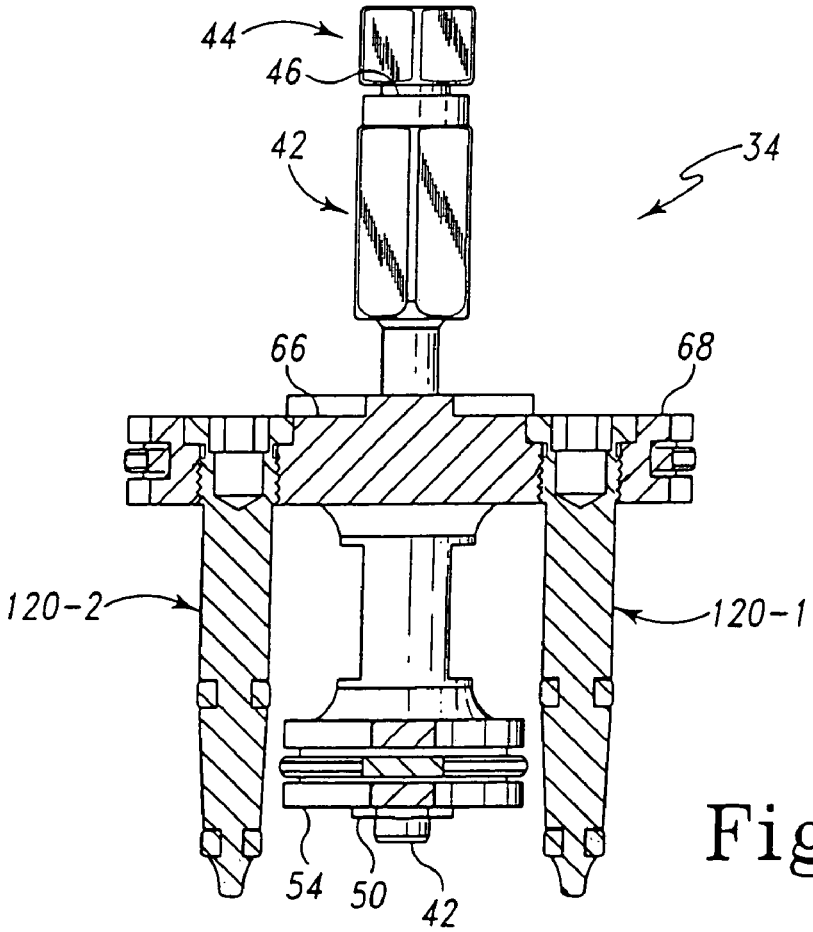

Referring now particularly to FIGS. 23–24, the flows of atomizing air, fan air, and coating material flows from nozzle 110 can be synchronized to occur in a desired order. In the embodiment of the piston 34 illustrated in FIGS. 23–24, this is achieved by valve members 120-1 and 120-2 mounted to piston 34 and extending forward in passageways 108, 114, respectively, to points at which passageways 108, 114 turns from generally perpendicular to surface 96 to generally parallel to surface 96 as passageways 108, 114 progress forward toward nozzle 110. For example, when cylinder air is first triggered on, piston 34 starts rearward against the urging of spring 64. Coating material begins to flow from nozzle 110, the coating material being atomized by the pressure drop across nozzle 110. Once piston 34 has traveled rearward a sufficient distance, valve members 120-1, 120-2 open passageways 108, 114 and atomizing air and fan air flow forward to nozzle 110 is established. The valve members 120-1 and 120-2 are illustrated as being the same length, resulting in passageways 108, 114 being opened to the nozzle 110 substantially simultaneously. However, it should be understood that the time sequence and time delay among the supply of coating material, atomizing air and fan air to nozzle 110 may be controlled by selection of valve members 120-1 and 120-2 having appropriate lengths, which may be the same or different. The illustrated piston 34 configuration permits the piston 34 and its associated components, including the wire collet to be assembled into, and removed from, the gun 20, for example, to service the O-ring seals on the piston 34, or to service the cartridge assembly 80, or to service the atomizing or fan air valve members 120-1, 120-2. This construction also permits the atomizing and/or fan air valve members 120-1, 120-2 to be removed from the piston 34 without removing the piston 34 from the cylinder 36 by removing cap 74 and spring 64 and unscrewing atomizing and/or fan air valve members 120-1, 120-2 from rearward face 68 of piston 34.

Figure 9:
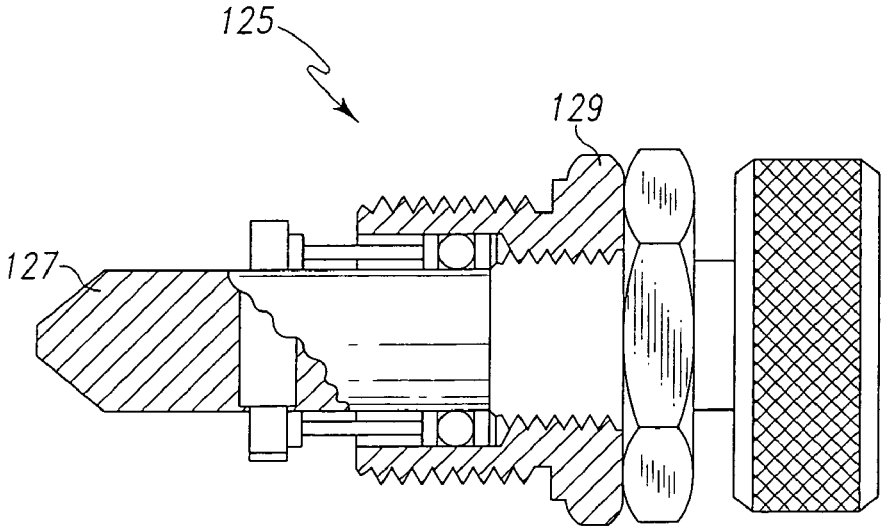
FIG. 9 illustrates an enlarged sectional view of a detail of an embodiment of the apparatus illustrated in FIGS. 1–8.

Instead of passageway 112 supplying fan air from fan air fitting 26 to passageway 114, other means may be provided for supplying and regulating the supply of fan air through passageway 114 from the atomizing air supply coupled to fitting 24. For example, and with reference to FIGS. 9–10, a passageway 122 may be provided across manifold 22 from passageway 106 to passageway 114. Fitting 26 can be plugged, and flow from passageway 106 to passageway 114 may be controlled by a valve mechanism 125 (FIG. 9) including a valve needle 127 which threads into a packing 129. Packing 129 is threaded into passageway 122 from the passageway 112 side. Valve needle 127 can be threaded into packing 129 a desired distance from a valve seat 131 (see FIG. 10) provided in passageway 122 to obstruct all but the desired fan airflow from passageway 106 through passageway 122 to passageway 114 and thence to the fan air outlets from nozzle 110. In this way, the amount of air delivered from passageway 106 to passageway 114 to serve as fan air can be controlled at any desired level within the capacities of port 24 and passageways 106, 122, 112 and 114. If fan air fitting 26 is to be unplugged and air is to be supplied from fan air fitting 26 in a manifold 22 including such a passageway 122, a plug 133 may be inserted into passageway 122 at the valve seat 131, and the external opening of passageway 122 closed with a threaded plug 135 having the same relevant dimensions as packing 129. See FIG. 10.

The manifold 22 includes a forward portion 150 and a rearward portion 152. The forward portion 150, which is exposed to the coating material being dispensed, is constructed from a material which is relatively unaffected by the coating material, for example, stainless steel. To reduce the weight of forward portion 150, it may be desirable to machine (a) cavity(ies) 154 in non-critical areas of the forward portion. Such cavities 154 are illustrated in the FIGS. 6–8. The rearward portion, which is exposed only to compressed air or the like, can be constructed from the same material, or from another, for example, lighter weight material, which is relatively unaffected by the compressed air. An example would be aluminum. The forward and rearward portions 150, 152, respectively, of the manifold are coupled together by dowel pins 156, one of which is illustrated in FIG. 8.

The gun 20 also is divided into a forward portion 160 and a rearward portion 162. Alignment between the forward and rearward portions of the gun 20 is promoted by locating pins 166, one of which is illustrated in FIG. 7. The forward and rearward portions 160, 162 are coupled together by cap bolts 167 inserted into bores extending forward from cylinder 36 and threaded into threaded bores in the back surface 180 of forward portion 160. One of cap bolts 167 is illustrated in broken lines in FIG. 6. As was the case with manifold 22, the forward portion 160 can be constructed from a material which is relatively unaffected by the coating material, for example, stainless steel, and the rearward portion from the same or a different material which is relatively unaffected by the compressed air. Gun 20 and manifold 22 are joined by cap bolts 168.

Manifold 22 can be mounted on a rod (not shown). To accommodate such a mounting, a passageway 190 is provided through manifold 22 for receiving such a rod. A threaded opening 192 intersects passageway 190 to accommodate a locking bolt for fixing the position of manifold 22 along the length of such a rod. Manifold 22 can also be mounted to, for example, a suitable bracket, not shown. Threaded holes 194 and holes 196 for locating pins are provided in the bottom surface 198 of manifold 22 for this purpose.

Referring now particularly to FIG. 6, a weep port 200 extends through manifold 22. A passageway 202 intersects weep port 200 and extends to surface 92. A mating passageway 204 extends from mating surface 96 to central passageway 98 behind cartridge 80. The presence of coating material in weep port 200 provides an indication that cartridge 80 is compromised, and in need of service.

Nozzle 110 includes a carbide tip assembly 208 including a spray orifice having a maximum dimension of, for example, 0.012" (about 0.3 mm.). The spray orifice may be circular, oval, cat's eye shaped, or any of a number of other desired shapes in cross section perpendicular to the nozzle 110 axis (in this case, generally perpendicular to the longitudinal extent of stem 40). Nozzle 110 also includes an air cap 210, details of which are best illustrated in FIGS. 11–22. Carbide tip assembly 208 is retained in air cap 210. Air cap 210, in turn, is retained against an ultra high molecular weight polymer (UHMW) fluid seat assembly 212 (FIG. 6) by a threaded retaining ring 214 which is threaded onto the front of forward portion 160 of gun 20. O-ring 216 seals the air cap 210 to the UHMW fluid seat assembly 212.

Referring particularly to FIGS. 11–22, air cap 210 includes two diametrically opposed wings 220, each of which illustratively includes two passageways 222 which extend generally perpendicularly to facing, generally parallel surfaces 224 of the wings 220, and a passageway 226 which extends forward at an angle of, for example, 60° to the axis 228 of air cap 210. The axes of passageways 222 lie at distances of, for example, 0.050" on either side of a plane 230 which bisects air cap 210 and includes the axis 228. The axes of passageways 226 lie in the plane 230. The axes of passageways 222 lie a distance of, for example, 0.082" (about 2.1 mm) forward of the front face 232 of air cap 210. The axes of passageways 226 where passageways 226 open through surfaces 224 lie a distance of, for example, 0.044" (about 1.1 mm) forward of front face 232. Passageways 222 and 226 have diameters of, for example, 0.040" (about 0.9 mm). Passageways 233 are provided through the outer surfaces of wings 220, for example, to aid in machining passageways 222, 226. Passageways 233 are closed by appropriate plugs 235 which are then machined during the assembly of air cap 210. See FIG. 18. Atomizing air from passageway 108 is coupled through passageways 222 and 226 onto the spray exiting from tip 208 to assist in atomizing and shaping the spray.

Six additional passageways 236 extend forwardly and radially inwardly at angles of, for example, 45° to the axis 228 of air cap 210. The axes of one diametrically opposed pair of passageways 236 lie generally in a plane 240 which bisects air cap 210 and lies generally parallel to surfaces 224. The axes of the remaining diametrically opposed pairs of passageways 236 lie generally in planes oriented at angles of, for example, 40° to plane 240, and intersect plane 240 on the axis 228 of air cap 210. Passageways 236 exit the face 232 of air cap 210 at a distance of, for example, about 0.218" (about 5.5 mm) from the axis 228 of air cap 210. Passageways 240 have diameters of, for example, 0.020" (about 0.5 mm). Atomizing air from passageway 108 is coupled through passageways 236 onto the spray exiting from tip 208 to assist in reducing the buildup of coating material on the carbide fluid tip 208 and on the air cap 210.

An additional pair of diametrically opposed passageways 244 exit from the front face 232 of air cap 210 a distance of, for example, 0.352" (about 8.9 mm) from the axis 228 of air cap 210. The axes of passageways 236 make angles of, for example, 20° with the front face 232 of air cap 210. Shaping air from passageway 114 is coupled through passageways 244 onto the spray exiting from tip 208 to assist in atomizing and shaping the spray.

What is claimed is:

1. A coating material dispensing apparatus including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a connection to a source of compressed gas or mixture of gases for dispensing with the coating material, and a second valve for controlling the dispensing of compressed gas or mixture of gases with the coating material, the second valve including a component coupled to the mechanism, the condition of the second valve being controlled by the mechanism, the mechanism including a piston and a cylinder in which the piston is reciprocable to move the first valve component to control the flow of coating material from the nozzle, the cylinder closed by a closure, the second valve component mounted to the piston from a closure side of the piston for movement with the piston, permitting removal of the second valve component by removing the closure and removing the second valve component without removing the piston from the cylinder.

2. The apparatus of claim 1 wherein the first valve component and piston are removable from the coating material dispensing device by opening the closure and withdrawing the piston from the cylinder.

3. A coating material dispensing device including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a first component providing the connection to a source of coating material to be dispensed, the coating material dispensing device further including a second component providing the nozzle, the first and second components including first and second passageways, respectively, the first and second passageways communicating when the first and second components are assembled together to provide a flow of coating material from the connection to the nozzle, the first component including separate first and second portions, the first portion of the first component including the first passageway, the second portion of the first component including a control port for controlling the first valve.

4. The apparatus of claim 3 wherein the first portion of the first component is constructed from a different material than the second portion of the first component.

5. The apparatus of claim 4 wherein the second component includes separate first and second portions, the first portion of the second component including the second passageway and the nozzle, the second portion of the second component including the mechanism.

6. The apparatus of claim 5 wherein the first portion of the second component is constructed from a different material than the second portion of the second component.

7. A coating material dispensing device including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a first component providing the connection to a source of coating material to be dispensed, the coating material dispensing device further including a second component providing the nozzle, the first and second components including first and second passageways, respectively, the first and second passageways communicating when the first and second components are assembled together to provide a flow of coating material from the connection to the nozzle, the second component including separate first and second portions, the first portion of the second component including the second passageway and the nozzle, the second portion of the second component including the mechanism.

8. The apparatus of claim 7 wherein the first portion of the second component is constructed from a different material than the second portion of the second component.

9. A coating material dispensing device including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a first component providing the connection to a source of coating material to be dispensed, the coating material dispensing device further including a second component providing the nozzle, the first and second components including first and second passageways, respectively, the first and second passageways communicating when the first and second components are assembled together to provide a flow of coating material from the connection to the nozzle, the second component including the mechanism, the dispensing device including a port for the introduction of a stream of compressed gas or mixture of gases into the stream of coating material dispensed from the nozzle, a third passageway for supplying the stream of compressed gas or mixture of gases to the nozzle, and a second valve for controlling the supply of compressed gas or mixture of gases from the port to the nozzle, the second valve coupled to the mechanism for operating the first valve to be controlled thereby, the port being provided in the first component and the third passageway being provided in the second component, the apparatus further including a fourth passageway provided in the first component and coupling the third passageway to the port.

10. The apparatus of claim 3 wherein the control port for controlling the first valve comprises a port for introducing into the apparatus an operating fluid for operating the first valve.

11. A coating material dispensing device including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a first component providing the connection to a source of coating material to be dispensed, the coating material dispensing device further including a second component providing the nozzle, the first and second components including first and second passageways, respectively, the first and second passageways communicating when the first and second components are assembled together to provide a flow of coating material from the connection to the nozzle, the second component including the mechanism, the first valve controlling the flow of coating material from the nozzle, the dispensing device including a port for the introduction of multiple streams of compressed gas or mixture of gases into the stream of coating material dispensed from the nozzle, a third passageway for supplying at least one of the multiple streams of compressed gas or mixture of gases to the nozzle, a second valve for controlling the supply of compressed gas or mixture of gases from the port to the nozzle, the second valve coupled to the mechanism to be controlled thereby, a fourth passageway for supplying at least another of the multiple streams of compressed gas or mixture of gases to the nozzle, a third valve for controlling the supply of compressed gas or mixture of gases to the fourth passageway, the third valve being continuously adjustable to vary the amount of compressed gas or mixture of gases supplied through the fourth passageway.

12. A coating material dispensing device including a connection to a source of coating material to be dispensed, a nozzle through which the coating material is dispensed, a first valve including a first valve component between the connection and the nozzle, the orientation of the first valve component controlling the flow of coating material from the nozzle, a mechanism for changing the orientation of the first valve component, the mechanism and first valve component being removable from the dispensing device as a unit, a first component providing the connection to a source of coating material to be dispensed, the coating material dispensing device further including a second component providing the nozzle, the first and second components including first and second passageways, respectively, the first and second passageways communicating when the first and second components are assembled together to provide a flow of coating material from the connection to the nozzle, a filter for filtering coating material to be dispensed, the first component including a housing for housing the filter, a closure for selectively closing the housing to permit removal and replacement of the filter, the first and second passageways communicating when the first and second components are assembled together to provide a flow of filtered coating material from the filter to the nozzle.

13. The apparatus of claim 12 wherein the first component includes separate first and second portions, the first portion of the first component including the housing, the closure and the first passageway.

14. The apparatus of claim 13 wherein the second portion of the first component includes a control port for controlling the valve.

* * * * *